US010280887B2

(12) United States Patent
Kato et al.

(10) Patent No.: US 10,280,887 B2
(45) Date of Patent: May 7, 2019

(54) FUEL INJECTION DEVICE

(71) Applicant: DENSO CORPORATION, Kariya, Aichi-pref. (JP)

(72) Inventors: Noritsugu Kato, Kariya (JP); Keita Imai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/554,095

(22) PCT Filed: Mar. 23, 2016

(86) PCT No.: PCT/JP2016/001665
§ 371 (c)(1),
(2) Date: Aug. 28, 2017

(87) PCT Pub. No.: WO2016/163086
PCT Pub. Date: Oct. 13, 2016

(65) Prior Publication Data

US 2018/0030943 A1 Feb. 1, 2018

(30) Foreign Application Priority Data

Apr. 9, 2015 (JP) ..... 2015-080286
Jul. 27, 2015 (JP) ..... 2015-147790

(51) Int. Cl.
*F02M 61/00* (2006.01)
*F02M 61/18* (2006.01)
*F02M 61/14* (2006.01)

(52) U.S. Cl.
CPC ..... *F02M 61/1833* (2013.01); *F02M 61/14* (2013.01); *F02M 61/18* (2013.01)

(58) Field of Classification Search
CPC ..... F02M 61/1833; F02M 16/18
See application file for complete search history.

(56) References Cited

U.S. PATENT DOCUMENTS 3,559,892 A * 2/1971 De Luca ..... F02M 45/08 239/533.4
4,069,978 A * 1/1978 El Moussa ..... F02M 61/1806 219/121.13

(Continued)

FOREIGN PATENT DOCUMENTS

JP 2007-32421 2/2007
JP 2010-48237 3/2010
JP 2015-214892 12/2015

OTHER PUBLICATIONS

International Search Report for PCT/JP2016/001665, dated May 17, 2016, 4 pages.

(Continued)

*Primary Examiner* — Thomas Moulis
(74) *Attorney, Agent, or Firm* — Nixon & Vanderhye P.C.

(57) ABSTRACT

In a fuel injection device including a body portion that forms an injection hole through which a fuel is injected, the body portion includes an inlet-channel-forming portion that is connected to an inflow port of the fuel in the injection hole and forms an inlet channel which is a fuel flow channel, and an outlet-channel-forming portion that is connected to the inlet channel and an outflow port of the fuel in the injection hole, and forms an outlet channel that is a fuel flow channel. A surface roughness of the outlet-channel-forming portion is larger than a surface roughness of the inlet-channel-forming portion.

57 Claims, 14 Drawing Sheets

(56) References Cited

U.S. PATENT DOCUMENTS 8,191,800 B2 * 6/2012 Kitagawa ..... F02M 51/061 239/533.12
8,328,121 B2 * 12/2012 Irino ..... F02M 61/1853 239/533.12
8,657,213 B2 * 2/2014 Sakata ..... F02M 61/1853 239/533.12
8,657,214 B2 * 2/2014 Matsumura ..... F02M 61/184 123/584
8,672,239 B2 * 3/2014 Ogura ..... F02M 61/1846 239/533.12
8,905,333 B1 * 12/2014 Sykes ..... F02M 61/1833 239/5
9,599,084 B2 * 3/2017 Kochanowski .... F02M 51/0671
9,605,637 B2 * 3/2017 Takada ..... F02M 61/1833
2001/0025892 A1 * 10/2001 McCoy ..... F02B 43/00 239/589
2002/0008166 A1 * 1/2002 Fukaya ..... F02M 61/168 239/533.12
2002/0158152 A1 * 10/2002 Hockenberger ... F02M 61/1806 239/533.12
2005/0258277 A1 * 11/2005 Joseph ..... F02M 61/168 239/533.14
2007/0012803 A1 * 1/2007 Shimizu ..... F02M 61/162 239/497
2007/0012805 A1 * 1/2007 Maier ..... F02M 51/0671 239/533.12
2009/0057444 A1 * 3/2009 Heyse ..... F02M 61/1853 239/461
2009/0200403 A1 * 8/2009 Hung ..... F02M 61/1806 239/533.12
2009/0272824 A1 * 11/2009 Kitagawa ..... F02M 51/061 239/585.5
2010/0051727 A1 * 3/2010 Irino ..... F02M 61/1806 239/548
2010/0193612 A1 * 8/2010 Schrade ..... F02M 51/0671 239/533.12
2011/0011954 A1 * 1/2011 Gunji ..... F02M 61/168 239/533.3
2012/0138712 A1 * 6/2012 Choi ..... F02M 61/184 239/584
2014/0261298 A1 * 9/2014 Sasidharan ..... F02B 19/18 123/275
2015/0021416 A1 * 1/2015 Raney ..... F02M 61/1806 239/558
2015/0034053 A1 * 2/2015 Maier ..... F02M 61/168 123/490
2015/0047611 A1 2/2015 Yasukawa et al.
2015/0204291 A1 * 7/2015 Schnobrich ..... F02M 61/184 239/584
2015/0285201 A1 * 10/2015 Serizawa ..... F02M 61/184 239/584
2015/0369192 A1 * 12/2015 Ge ..... F02M 45/086 123/445
2016/0025057 A1 * 1/2016 Kato ..... F02M 61/1893 239/584
2016/0061139 A1 3/2016 Imai et al.
2016/0131098 A1 * 5/2016 Ito ..... F02M 61/1833 239/562
2016/0195052 A1 * 7/2016 Kaneta ..... F02M 61/1833 123/299
2016/0319792 A1 * 11/2016 Agresta ..... F02M 61/1846
2016/0341165 A1 * 11/2016 Ishikawa ..... F02M 61/1833
2016/0356253 A1 * 12/2016 Noguchi ..... F02M 61/184
2018/0073478 A1 * 3/2018 Noguchi ..... F02M 61/1833
2018/0142657 A1 * 5/2018 Kobayashi ..... F02M 61/1806
2018/0202405 A1 * 7/2018 Kato ..... F02M 61/184
2018/0283338 A1 * 10/2018 Soerensen ..... F02M 61/1806

OTHER PUBLICATIONS

Written Opinion of the ISA for PCT/JP2016/001665, dated May 17, 2016, 7 pages.

* cited by examiner

FUEL INJECTION DEVICE

CROSS-REFERENCE TO RELATED APPLICATION

This application is the U.S. national phase of International Application No. PCT/JP2016/001665 filed Mar. 23, 2016, which designated the U.S. and claims priority to Japanese Patent Application No. 2015-80286 filed on Apr. 9, 2015 and Japanese Patent Application No. 2015-147790 filed on Jul. 27, 2015, the entire contents of each of which are incorporated herein by reference.

TECHNICAL FIELD

The present disclosure relates to a fuel injection device.

Embodiments for Carrying out Invention

A fuel injection device that injects a fuel into a cylinder of an internal combustion engine has been known. For example, as illustrated in Patent Literature 1, an injection hole is formed in a fuel injection device, and the fuel is injected from an outflow port of the injection hole.

When the fuel is injected from the outflow port of the injection hole, it is desirable that the fuel is atomized. When the atomization of the fuel is promoted, a fuel economy can be improved. Patent Literature 1 discloses a fuel injection device having an injection hole of which diameter increases along a direction from an inflow port to the outflow port. However, in the fuel injection device disclosed in Patent Literature 1, the degree of atomization of the fuel is insufficient, and it is desirable to have a configuration capable of more atomizing the fuel.

PRIOR ART LITERATURES

Patent Literature

Patent Literature 1: JP 2013-199876 A

SUMMARY OF INVENTION

It is an object of the present disclosure to provide a fuel injection device capable of more atomizing a fuel injected from an outflow port of an injection hole.

According to one aspect of the present disclosure, in a fuel injection device including a body portion that forms an injection hole through which a fuel is injected, the body portion includes an inlet-channel-forming portion that is connected to an inflow port of the fuel in the injection hole and forms an inlet channel that is a fuel flow channel, and an outlet-channel-forming portion that is connected to the inlet channel and an outflow port of the fuel in the injection hole, and forms an outlet channel that is a fuel flow channel, and a surface roughness of the outlet-channel-forming portion is larger than a surface roughness of the inlet-channel-forming portion.

As a mode in which the surface roughness of the outlet-channel-forming portion is larger than the surface roughness of the inlet-channel-farming portion, for example, multiple convex portions or concave portions are formed in the outlet-channel-forming portion. In such a case, a flow rate of the fuel is easily maintained when passing through the inlet-channel-forming portion having a relatively small surface roughness. When the fuel passes through the outlet-channel-forming portion having a relatively large surface roughness, the fuel flow is easily disturbed. When the fuel of which flow has been disturbed is injected from the outflow port, the fuel is atomized by being diffused in various directions.

As a mode in which the surface roughness of the outlet-channel-forming portion is larger than the surface roughness of the inlet-channel-forming portion, multiple grooves extending from the inflow port to the outflow port are formed in the outlet-channel-forming portion. In such a case, when passing through the outlet channel, the fuel tends to flow along the groove. Since the fuel flows along the groove, the fuel spreads in the radial direction of the injection hole and the liquid film tends to become thin. Therefore, the fuel injected from the outflow port is atomized.

According to another aspect of the present disclosure, in the fuel injection device including the body portion that forms an injection hole through which a fuel is injected, the body portion includes an inlet-channel-forming portion that is connected to an inflow port of the fuel in the injection hole and forms an inlet channel which is a fuel flow channel, and an outlet-channel-forming portion that is connected to the inlet channel and an outflow port of the fuel in the injection hole, and forms an outlet channel that is a fuel flow channel, the diameters of the inlet channel and the outlet channel are expanded along a direction from the inflow port toward the outflow port, and a diameter expansion ratio which is a degree of expanding the diameter of the outlet channel is larger than a diameter expansion ratio which is a degree of expanding the diameter of the inlet channel.

As above, since the inlet channel is expanded, the fuel flowing into the injection hole from the inflow port spreads in the radial direction of the injection hole when colliding with the inner wall of the injection hole, as a result of which the liquid film becomes thin. The fuel of which liquid film has been thinned in the inlet channel in advance becomes thinner in the outlet channel having a larger diameter expansion ratio than that of the inlet channel. For that reason, the fuel injected from the outflow port is atomized.

EMBODIMENTS FOR CARRYING OUT INVENTION

Figure 1:
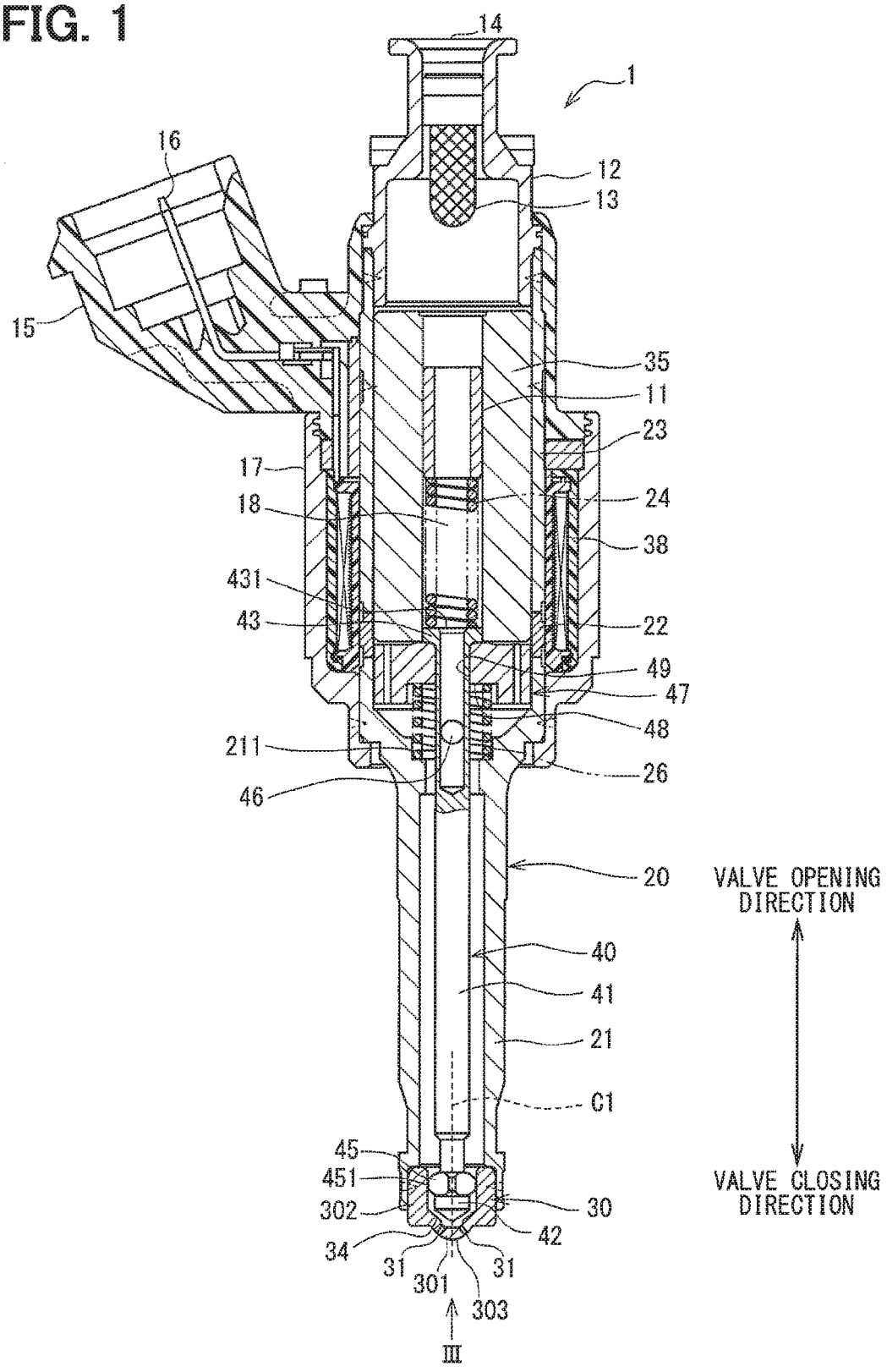
FIG. 1 is a cross-sectional view of a fuel injection device according to a first embodiment of the present disclosure.

Hereinafter, embodiments of the present disclosure will be described with reference to the drawings. Hereinafter, plural embodiments for carrying out the invention will be described with reference to the accompanying drawings. In the respective embodiments, a part that corresponds to a matter described in a preceding embodiment may be assigned the same reference numeral, and redundant explanation for the part may be omitted. In a case where partial description is provided with regard to the configuration of any one of the embodiments, the other embodiments already described can be referred to for application when it comes to the rest of the parts of the configuration.

(First Embodiment)

Figure 2:
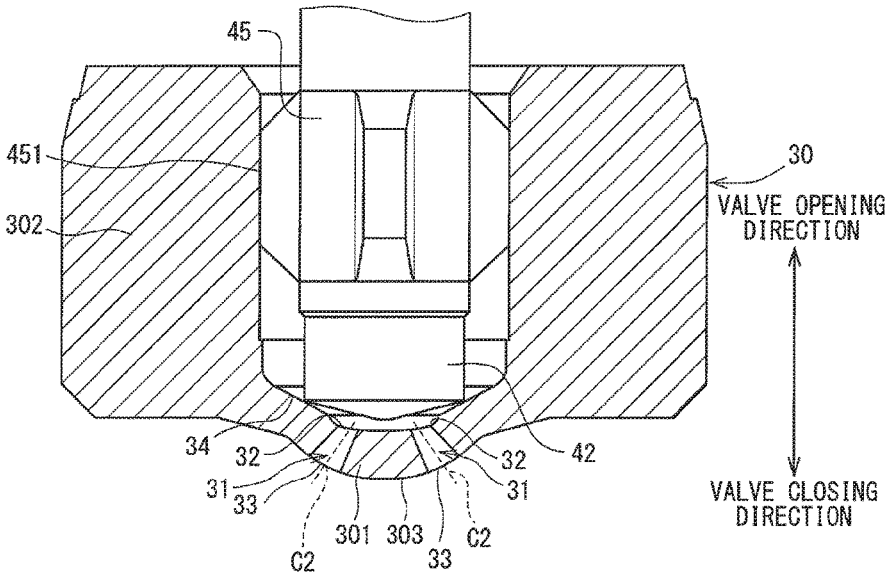
FIG. 2 is an enlarged cross-sectional view of a vicinity of a tip including an injection hole of the fuel injection device according to the first embodiment of the present disclosure.

A fuel injection device 1 according to a first embodiment of the present disclosure is illustrated in FIGS. 1 and 2. FIG. 1 illustrates a valve opening direction that is a direction along which a needle 40 is separated from a valve seat 34 and a valve closing direction along which the needle 40 abuts against the valve seat 34.

A fuel injection valve 1 is used in, for example, a fuel injection device for a direct injection gasoline engine not shown and injects a gasoline as a fuel into an engine. The fuel injection valve 1 includes a housing 20, the needle 40, a movable core 47, a fixed core 35, a coil 38, springs 24, 26, and so on.

As illustrated in FIG. 1, the housing 20 includes a first cylinder member 21, a second cylinder member 22, a third cylinder member 23, and a body portion 30. Each of the first cylinder member 21, the second cylinder member 22, and the third cylinder member 23 is formed in a substantially cylindrical shape, and the first cylinder member 21, the second cylinder member 22, and the third cylinder member 23 are coaxially disposed in the stated order and are connected to each other.

The first cylinder member 21 and the third cylinder member 23 are made of a magnetic material such as ferritic stainless steel, and subjected to a magnetic stabilization treatment. The first cylinder member 21 and the third cylinder member 23 are relatively low in hardness. On the other hand, the second cylinder member 22 is made of a nonmagnetic material such as austenitic stainless steel. The hardness of the second cylinder member 22 is higher than the hardness of the first cylinder member 21 and the third cylinder member 23.

The body portion 30 is disposed on an end portion of the first cylinder member 21 on a side opposite to the second cylinder member 22. The body portion 30 is formed in a bottomed cylindrical shape, made of a metal such as martensitic stainless steel, and welded to the first cylinder member 21. The body portion 30 is subjected to a quenching treatment so as to form a predetermined hardness. The body portion 30 includes an injection portion 301 and a tubular portion 302.

The injection portion 301 is line symmetrically formed with respect to a central axis C1 of the housing 20 as an axis of symmetry. In the fuel injection valve 1, an outer wall 303 of the injection portion 301 has a spherical shape centered on a point on the central axis C1 and is formed so as to protrude along a direction of the central axis C1 The injection portion 301 has multiple injection holes 31 that communicate an inside and an outside of the housing 20 with each other. In the present embodiment, the injection holes 31 are formed by performing laser irradiation from the outside of the body portion 30. In the body portion 30 according to the first embodiment, six injection holes 31 are formed. An annular valve seat 34 is formed on an outer periphery of inflow ports 32 which are openings on a side of the injection holes 31 into which a fuel in the housing 20 flows. Outflow ports 33 that are openings on a side of the injection holes 31 from which the fuel in the housing 20 flows out are formed in the outer wall 303 of the injection portion 301. A detailed structure of the body portion 30 will be described later.

The tubular portion 302 surrounds a radially outer side of the injection portion 301, and extends in a direction opposite to a direction in which the outer wall 303 of the injection portion 301 protrudes. The tubular portion 302 has one end portion connected to the injection portion 301 and the other end portion connected to the first cylinder member 21.

The needle 40 is made of a metal such as martensitic stainless steel. The needle 40 is subjected to a quenching treatment so as to have a predetermined hardness. The hardness of the needle 40 is set to be substantially equal to the hardness of the body portion 30.

The needle 40 is housed in the housing 20. The needle 40 includes a shaft portion 41, a seal portion 42, a large diameter portion 43, and so on. The shaft portion 41, the seal portion 42, and the large diameter portion 43 are integrated with each other.

The shaft portion 41 is formed into a cylindrical rod shape. A sliding contact portion 45 is formed in the vicinity of the seal portion 42 of the shaft portion 41. The sliding contact portion 45 is formed in a cylindrical shape and has an outer wall 451 partially chamfered. A non-chamfered portion of the outer wall 451 in the sliding contact portion 45 is slidable on an inner wall of the body portion 30 (tubular portion 302). With the above configuration, a reciprocating movement of the needle 40 on a tip end portion on the valve seat 34 is guided. The shaft portion 41 is formed with a hole 46 that connects an inner wall and an outer wall of the shaft portion 41.

The seal portion 42 is disposed on an end portion of the shaft portion 41 on the valve seat 34 so as to be abuttable against the valve seat 34. When the seal portion 42 is spaced apart from the valve seat 34 or abuts against the valve seat 34, the needle 40 opens or closes the injection holes 31, and allows or blocks a communication between the internal and the external of the housing 20.

The large diameter portion 43 is disposed on a side of the shaft portion 41 opposite to the seal portion 42. An outer diameter of the large diameter portion 43 is formed to be larger than an outer diameter of the shaft portion 41. An end face of the large diameter portion 43 on the valve seat 34 is abuttable against the movable core 47.

The needle 40 is reciprocated inside of the housing 20 while the sliding contact portion 45 is supported by the inner wall of the body portion 30, and the shaft portion 41 is supported by the inner wall of the second cylinder member 22 through the movable core 47.

The movable core 47 is formed in a substantially tubular shape and made of a magnetic material such as ferritic stainless steel, and a surface of the movable core 47 is subjected to, for example, chrome plating. The movable core 47 is magnetically stabilized. The hardness of the movable core 47 is relatively low, and is approximately equal to the hardness of the first cylinder member 21 and the third cylinder member 23 of the housing 20. A through hole 49 is formed substantially in the center of the movable core 47. The shaft portion 41 of the needle 40 is inserted into the through hole 49.

The fixed core 35 is formed in a substantially cylindrical shape and made of a magnetic material such as ferritic stainless steel. The fixed core 35 is magnetically stabilized. The hardness of the fixed core 35 is relatively low and substantially equal to the hardness of the movable core 47. However, in order to secure a function as a stopper of the movable core 47, a surface of the fixed core 35 is subjected to, for example, chromium plating, and secures a necessary hardness. The fixed core 35 is welded to the third cylinder member 23 of the housing 20 and is fixed to the inside of the housing 20.

The coil 38 is formed in a substantially cylindrical shape and surrounds, particularly, radially outer sides of the second cylinder member 22 and the third cylinder member 23 of the housing 20. The coil 38 generates a magnetic force when an electric power is supplied to the coil 38. When the magnetic field is developed around the coil 38, a magnetic circuit is formed by the fixed core 35, the movable core 47, the first cylinder member 21, and the third cylinder member 23. With the above configuration, a magnetic attraction force is generated between the fixed core 35 and the movable core 47, and the movable core 47 is attracted to the fixed core 35. In this situation, the needle 40 that abuts against a surface of the movable core 47 opposite to the valve seat 34 travels to the fixed core 35, that is, in the valve opening direction together with the movable core 47.

The spring 24 is disposed such that one end of the spring 24 abuts against a spring abutment surface 431 of the large diameter portion 43. The other end of the spring 24 abuts against one end of an adjusting pipe 11 that is press-fitted into an inside of the fixed core 35. The spring 24 has a force extending in the axial direction. With the above configuration, the spring 24 urges the needle 40 in a direction of the valve seat 34, that is, in the valve closing direction together with the movable core 47.

One end of the spring 26 abuts against a step surface 48 of the movable core 47. The other end of the spring 26 abuts against an annular stepped surface 211 formed inside of the first cylinder member 21 of the housing 20. The spring 26 has a force extending in the axial direction, With the above configuration, the spring 26 urges the movable core 47 in a direction opposite to the valve seat 34, that is, in the valve opening direction together with the needle 40.

In the present embodiment, an urging force of the spring 24 is set to be larger than an urging force of the spring 26. With the above configuration, in a state where no electric power is supplied to the coil 38, the seal portion 42 of the needle 40 is in a state to abut against the valve seat 34, that is, in a valve closing state.

A substantially cylindrical fuel introduction pipe 12 is fitted into and welded to an end portion of the third cylinder member 23 opposite to the second cylinder member 22. A filter 13 is disposed inside of the fuel introduction pipe 12. The filter 13 collects a foreign matter contained in the fuel flowing into the filter 13 from an introduction port 14 of the fuel introduction pipe 12.

Radially outer sides of the fuel introduction pipe 12 and the third cylinder member 23 are molded with resin. A connector 15 is formed at the mold part. A terminal 16 for supplying the electric power to the coil 38 is insert-molded into the connector 15. In addition, a cylindrical holder 17 is disposed on a radially outer side of the coil 38 so as to cover the coil 38.

The fuel flowing from the introduction port 14 of the fuel introduction pipe 12 flows in a radially inner direction of the fixed core 35, an inside of the adjusting pipe 11, the inside of the large diameter portion 43 and the shaft portion 41 of the needle 40, the hole 46, and a gap between the first cylinder member 21 and the shaft portion 41 of the needle 40, and is introduced into the inside of the body portion 30. In other words, a portion extending from the introduction port 14 of the fuel introduction pipe 12 to the gap between the first cylinder member 21 and the shaft portion 41 of the needle 40 serves as a fuel passage 18 for introducing the fuel into the body portion 30. When the fuel injection valve 1 is in operation, the periphery of the movable core 47 is filled with fuel.

Next, a state of the injection hole 31*s* will be described based on an enlarged view of a front end portion of the fuel injection valve 1 in the valve closing direction, illustrated in FIG. 2. The outflow ports 33 of the injection holes 31 are formed outside the inflow ports 32 with respect to the central axis C1. For that reason, the fuel flowing from the fuel passage 18 to the inflow ports 32 is injected outward from the outflow ports 33. In other words, a central axis C2 of each injection hole 31 separates from the central axis C1 from the inflow port 32 toward the outflow port 33.

Figure 3:
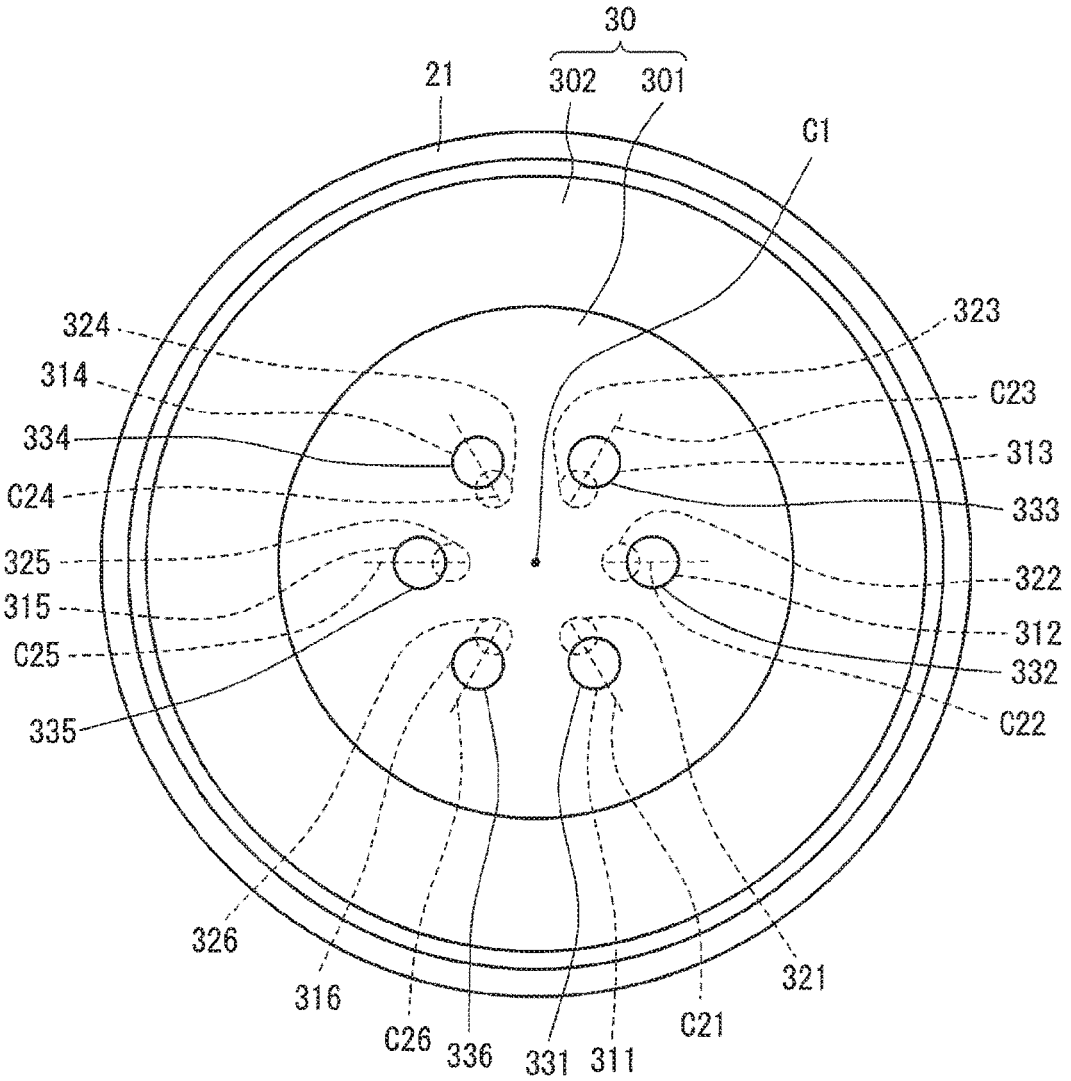
FIG. 3 is a view of the tip of the fuel injection device as viewed from an outflow port of the injection hole according to the first embodiment of the present disclosure.

Next, a view of the body portion 30 as seen from the outflow port 33 will be described with reference to FIG. 3.

In the fuel injection valve 1, six injection holes 31 are formed in the body portion 30. More specifically, as illustrated in FIG. 3, injection holes 311, 312, 313, 314, 315, and 316 are formed. Further, outflow ports 331 to 336 of the respective injection holes 311 to 316 are formed on an outer side in comparison with respective inflow ports 321 to 326.

Next, an enlarged view of the injection holes 31 according to the present embodiment will be described with reference to the injection holes 311 of FIG. 4 as an example. For simplification of description, the injection holes 312 to 316 will not be described, but are the same as the injection hole 311. that is, have the same shape as that of the injection hole 311.

Figure 4:
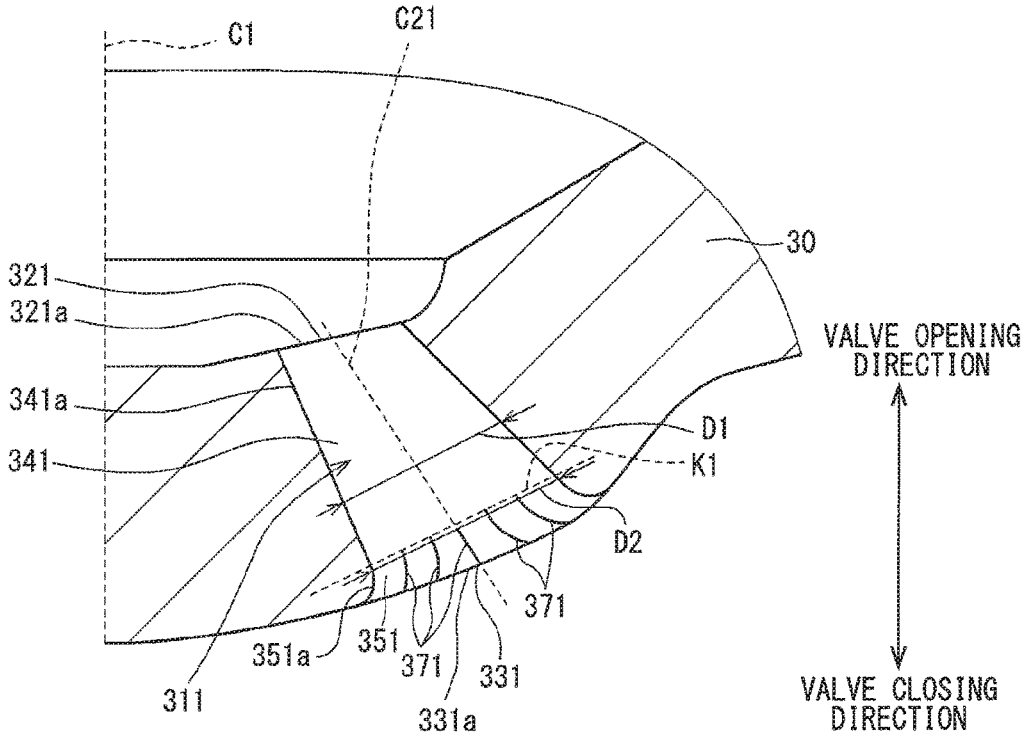
FIG. 4 is an enlarged cross-sectional view of a vicinity of the injection hole in the fuel injection device according to the first embodiment of the present disclosure.

As illustrated in FIG. 4, the injection hole 311 is formed in the body portion 30. More specifically, the body portion 30 forms an inflow port 321, an outflow port 331 inlet channel 341, and an outlet channel 351.

An edge forming the inflow port 321 in the body portion 30 is called an inflow-port portion 321*a*. An edge forming the outflow port 331 is called an outflow-port portion 331*a*. A wall surface forming the inlet channel 341 is called an inlet-channel-forming portion 341*a*. A wall surface forming the outlet channel 351 in the body portion 30 is called an outlet-channel-forming portion 351*a*.

The inflow port 321 is formed in a circular shape by the inflow-port portion 321*a*. The outflow port 331 is formed in a circular shape by the outflow-port portion 331*a* on a valve closing direction of the inflow port 321.

In addition, a flow channel communicating the inflow port 321 with the outflow port 331 is formed by the body portion 30. In the present embodiment, the flow channel of the injection hole 311 includes two types of flow channels of the inlet channel 341 and the outlet channel 351.

The inlet-channel-forming portion 341*a* extends from the inflow port 321 toward the outflow port 331, and has a cylindrical shape. One end of the inlet-channel-forming portion 341*a* on the inflow port 321 is connected to the inflow-port portion 321*a*.

The outlet-channel-forming portion 351*a* connects the inlet-channel-forming portion 341*a* to the outflow-port portion 331*a*, and has a cylindrical shape. More specifically, one end of the inlet-channel-forming portion 341*a* on the outflow port 331 and one end of the outlet-channel-forming portion 351*a* on the inflow port 321 are connected to each other. The other end of the outlet-channel-forming portion 351*a* on an opposite side to the above one end and the outflow-port portion 331*a* are connected to each other.

In addition, a surface roughness of the outlet-channel-forming portion 351*a* is larger than a surface roughness of the inlet-channel-forming portion 341*a*. The surface roughness can be expressed by an arithmetic average roughness, a maximum height, a ten point average roughness, or the like. In the present embodiment, the surface roughness is expressed by the ten-point average roughness.

In the present embodiment, the surface roughness of the inlet-channel-forming portion 341*a* is 0.4 μm, and the surface roughness of the outlet-channel-forming portion 351*a* is 0.5 μm. Incidentally, the surface roughness of the inlet-channel-forming portion 341*a* and the surface roughness of the outlet-channel-forming portion 351*a* are not limited to the above values, but can be appropriately changed.

For that reason, the fuel that has flowed from the inflow port 321 passes through the inlet channel 341 and the outlet channel 351, and is injected from the outflow port 331. In addition, in the present embodiment, a boundary between the inlet channel 341 and the outlet channel 351 is indicated by a virtual line K1.

Next, the shapes of the inlet channel 341 and the outlet channel 351 will be described. The diameter D1 of the inlet channel 341 is increased, that is, the diameter of the inlet channel 341 is increased along a direction from the inflow port 321 toward the outflow port 331. The diameter expansion ratio, which is the degree of expanding the diameter D1 of the inlet channel 341 is kept constant.

The diameter D2 of the outlet channel 351 is increased, that is, the diameter of the outlet channel 351 is increased along a direction from the inflow port 321 toward the outflow port 331. The diameter expansion ratio, which is the degree of expanding the diameter D2 of the outlet channel 351 is increased along a direction from the inflow port 321 toward the outflow port 331.

The diameter D2 of the outlet channel 351 is larger than the diameter D1 of the inlet channel 341. More specifically, a minimum size of the diameter D2 of the outlet channel 341 is larger than a maximum size of the diameter D1 of the inlet channel 341.

For that reason, the diameter of the injection hole 311 is increased along a direction from the inflow port 321 toward the outflow port 331. Further, the injection hole 311 has multiple stages in which the diameter of the injection hole 311 is increased.

Figure 5:
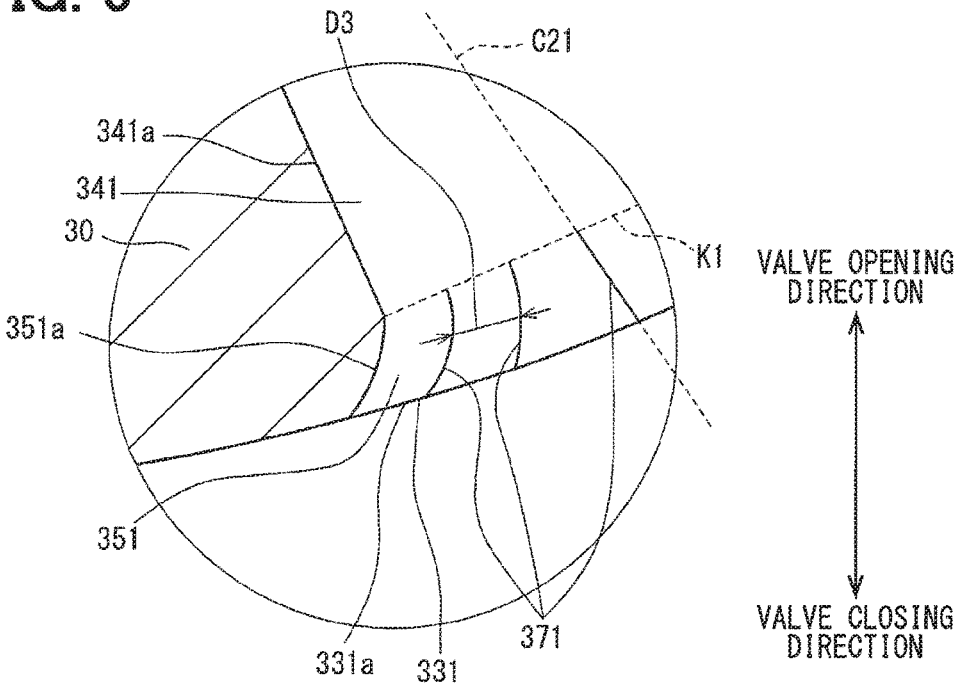
FIG. 5 is an enlarged cross-sectional view of a part of an outlet channel in the fuel injection device according to the first embodiment of the present disclosure.

In addition, multiple grooves 371 are formed in the outlet-channel-forming portion 351*a* that forms the outlet channel 351. The multiple grooves 371 extend along a direction from the inflow port 321 to the outflow port 331, respectively, and are formed so as to be arranged at regular intervals in a circumferential direction of the outlet-channel-forming portion 351*a*. In FIGS. 4 and 5, the number of grooves 371 is omitted as compared with an actual number of grooves 371 for the sake of clarity of the drawing.

Next, the outlet channel 351 will be described in more detail with reference to FIG. 5. FIG. 5 is an enlarged view of a vicinity of the outlet channel 351 in FIG. 4. As illustrated in FIG. 5, in the interval D3 between the respective grooves 371, the interval D3 on the outflow port 331 is larger than the interval D3 on the inflow port 321. More specifically, the interval D3 between the respective grooves 371 becomes wider along a direction from the inflow port 321 toward the outflow port 331.

Figure 6:
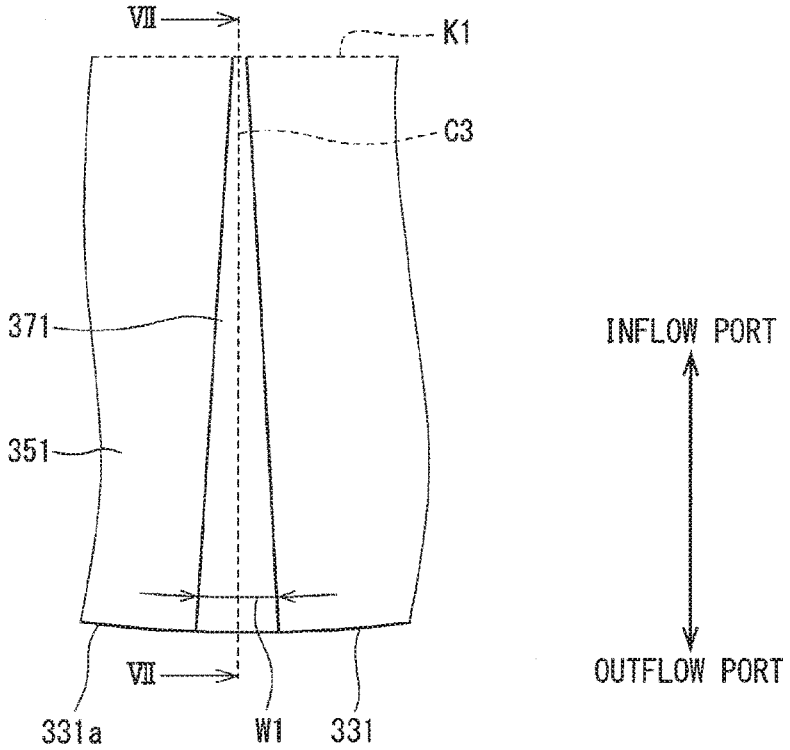
FIG. 6 is an enlarged view of a groove formed in the injection hole of the fuel injection device according to the first embodiment of the present disclosure.

FIG. 6 is an enlarged view of the periphery of the grooves 371. As illustrated in FIG. 6, in a width W1 of the grooves 371, the width W1 on the outflow port 331 is larger than the width WI on the virtual line K1. More specifically, the width W1 of the grooves 371 becomes wider along a direction from the virtual line K1 toward the outflow port 331.

That is, in the width W1 of the grooves 371, the width W1 on the outflow port 331 is larger than the width W1 on the inflow port 321. More specifically, the width W1 of the grooves 371 becomes wider along a direction from the inflow port 321 toward the outflow port 331.

Figure 7:
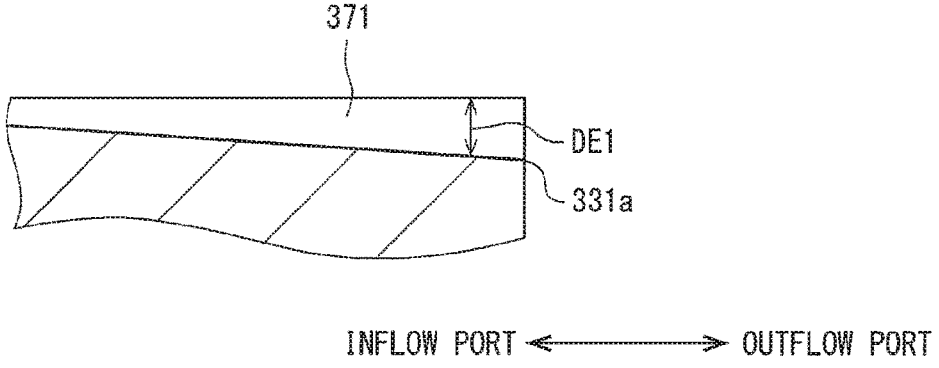
FIG. 7 is a cross-sectional view taken along a line VII-VII in FIG. 6.

FIG. 7 is a cross-section taken along a center of the groove 371 in FIG. 6 and viewed from a lateral direction. As illustrated in FIG. 7, in a depth DE1 of the groove 371, a depth DE1 on the outflow port 331 is deeper than a depth DE1 on the inflow port 321. More specifically, the depth DE1 of the groove 371 is deeper along a direction from the inflow port 321 to the outflow port 331.

Hereinafter, effects of the fuel injection device 1 according to the present embodiment will be described.

The fuel injection device 1 includes the body portion 30 forming an injection hole 311 through which fuel is injected. The body portion 30 includes the inlet-channel-forming portion 341*a* that is connected to the fuel inflow port 321 of the injection hole 311 and forms the inlet channel 341 which is a fuel flow channel. Further, the body portion 30 includes the outlet-channel-forming portion 351*a* which is connected to the inlet channel 341 and the fuel outflow port 331 of the injection hole 311, and forms the outlet channel 351 which is a fuel flow channel. The surface roughness of the outlet-channel-forming portion 351*a* is larger than the surface roughness of the inlet-channel-forming portion 351*a*.

In the present embodiment, multiple grooves 371 extending along a direction from the inflow port 321 to the outflow port 331 are formed in the outlet-channel-forming portion 351*a*, to thereby differentiate the surface roughness of the outlet-channel-forming portion 351*a* from the surface roughness of the inlet-channel-forming portion 351*a*.

For that reason, when passing through the outlet channel 351, the fuel tends to flow along the grooves 371. Since the fuel flows along the grooves 371, and the fuel spreads in the radial direction of the injection hole 311, the liquid film tends to become thin. Therefore, the fuel injected from the outflow port 331 is atomized.

The distance D3 between the respective grooves 371 becomes longer along a direction from the inflow port 321 toward the outflow 331 port. The depth DE1 of the grooves 371 becomes deeper along a direction from the inflow port 321 toward the outflow port 331. The width W1 of the grooves 371 becomes wider along a direction from the inflow port 321 toward the outflow port 331.

With the above configuration, the fuel flowing through the outlet channel 351 tends to flow along the grooves 371 more toward the outflow port 331. In addition, the fuel passing through the grooves 371 is easily divided. Accordingly, the liquid film of the fuel injected from the outlet channel 351 is more likely to be thinner. Therefore, the atomization of the fuel is promoted.

Further, the outlet channel 351 is formed so as to increase the diameter of the outlet channel 351 along a direction from the inflow port 321 toward the outflow port 331.

With the above configuration, when passing through the outlet channel 351, the fuel spreads along the outlet-channel-forming portion 351*a* and the liquid film of the fuel becomes thin. Therefore, the fuel injected from the outflow port 331 is atomized because the liquid film becomes thinner.

(Second Embodiment)

In the fuel injection device 1 according to the above embodiment, with the provision of the grooves 371 in the outlet-channel-forming portion 351*a*, the surface roughness of the outlet-channel-forming portion 351*a* is set to be larger than the surface roughness of the inlet-channel-forming portion 341*a*. In the present embodiment, with the provision of convex portions on an outlet-channel-forming portion 351*a*, a surface roughness of the outlet-channel-forming portion 351*a* is set to be larger than a surface roughness of an inlet-channel-forming portion 341*a*.

An appearance of the injection hole 311 according to the present embodiment will be described with reference to FIG. 8. Because the other portions are identical with those in the first embodiment, their description will be omitted.

Figure 8:
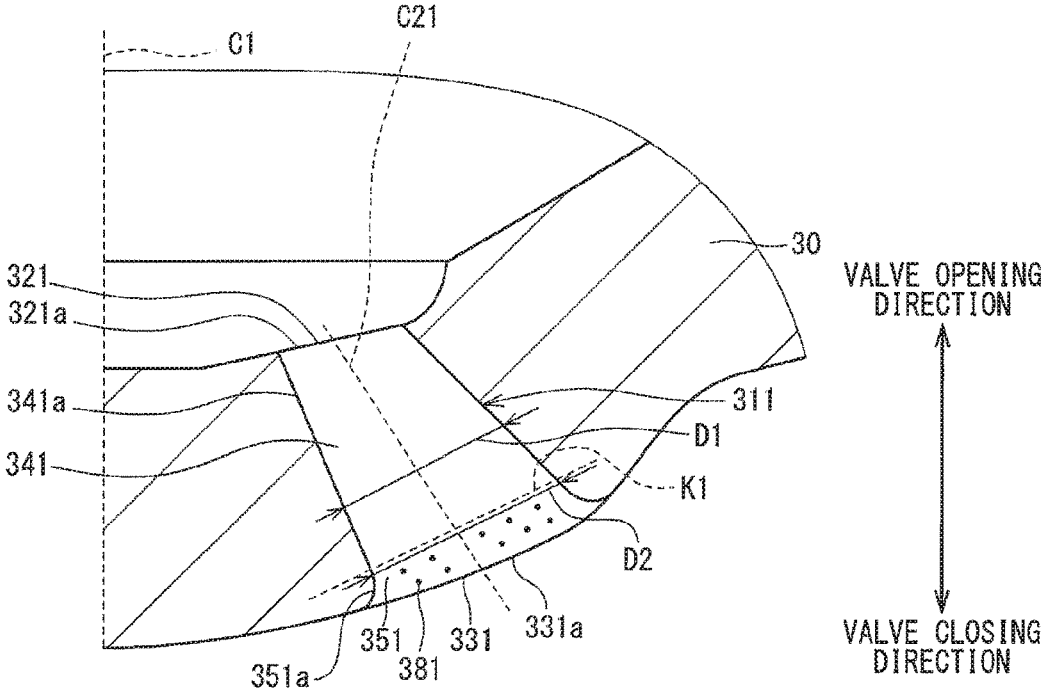
FIG. 8 is an enlarged cross-sectional view of a vicinity of an injection hole in a fuel injection device according to a second embodiment of the present disclosure.

As illustrated in FIG. 8, multiple convex portions 381 are formed on the outlet-channel-forming portion 351*a* of the injection hole 311. For that reason, the surface roughness of the outlet-channel-forming portion 351*a* is larger than the surface roughness of the inlet-channel-forming portion 341*a*. It is to be noted that, for the sake of clarity of the drawing, reference numerals are omitted, but dots similar to the convex portions 381 denoted by a reference numeral in FIG. 8 are the convex portions 381. For the sake of clarity of the drawing, the number of convex portions 381 is omitted as compared with an actual number of convex portions 381.

Hereinafter, effects of the fuel injection device 1 according to the present embodiment will be described.

The outlet-channel-forming portion 351*a* is formed with multiple convex portions 381.

In such a case, a flow rate of the fuel is easily maintained when passing through the inlet-channel-forming portion 341*a* having a relatively small surface roughness. When the fuel of which flow rate has been maintained passes through the outlet-channel-forming portion 351*a* having a relatively large surface roughness, the fuel flow is easily disturbed. When the fuel of which flow has been disturbed is injected from the outflow port, the fuel is atomized by being diffused in various directions.

(Third Embodiment)

In the first embodiment and the second embodiment described above, the surface roughness of the outlet-channel-forming portion 351*a* is set to be larger than the surface roughness of the inlet-channel-forming portion 341*a*, to thereby promote the atomization. The fuel injection device 1 according to the present embodiment promotes the atomization by setting the diameter expansion ratio of the inlet channel 341 and the outlet channel 351 to be different from each other. In the present embodiment, the surface roughness of the outlet-channel-forming portion 351*a* is the same as the surface roughness of the inlet-channel-forming portion 341*a*.

Figure 9:
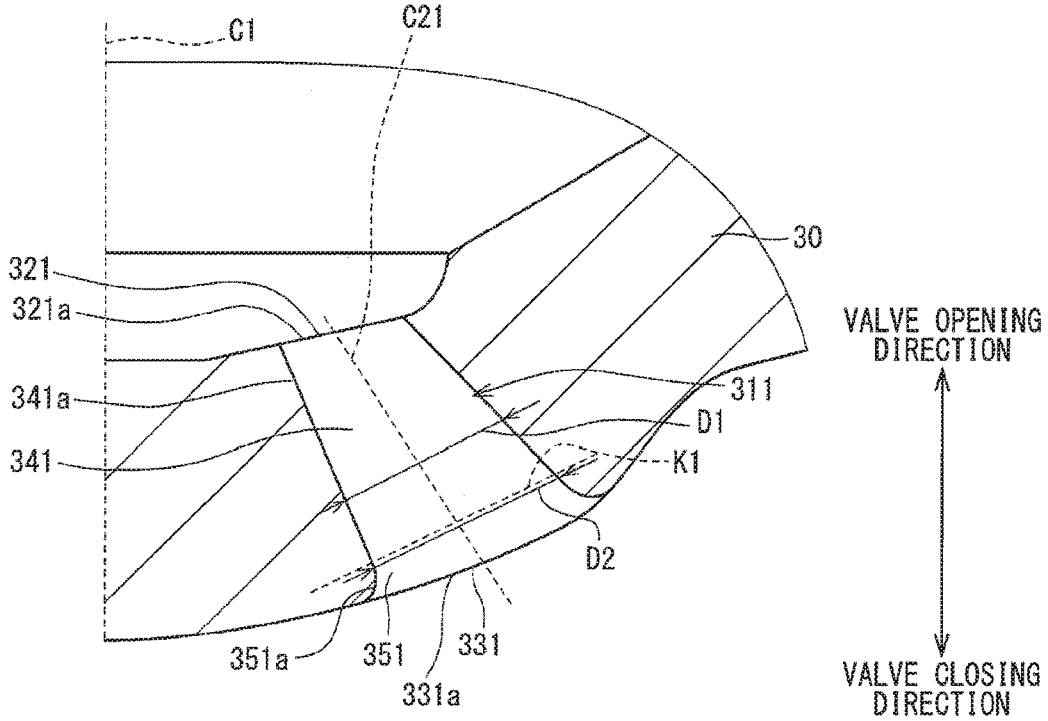
FIG. 9 is an enlarged cross-sectional view of a vicinity of the injection hole in a fuel injection device according to a third embodiment of the present disclosure.

An appearance of the injection hole 311 according to the present embodiment will be described with reference to FIG. 9. The diameter D1 of the inlet channel 341 is increased, that is, the diameter of the inlet channel 341 is increased along a direction from the inflow port 321 toward the outflow port 331. The diameter D2 of the outlet channel 351 is increased, that is, the diameter of the outlet channel 351 is increased along a direction from the inflow port 321 toward the outflow port 331.

The diameter expansion ratio, which is the degree of expanding the diameter D1 is kept constant. The diameter expansion ratio, which is the degree of expanding the diameter D2 is increased along a direction from the inflow port 321 toward the outflow port 331. In addition, the diameter D2 is larger than the diameter Dl.

Hereinafter, effects of the fuel injection device 1 according to the present embodiment will be described.

The diameters of the inlet channel 341 and the outlet channel 351 are expanded along a direction from the inflow port 321 toward the outflow port 331. The diameter expansion ratio which is the degree of expanding the diameter of the outlet channel 351 is larger than the diameter expansion ratio which is the degree of expanding the diameter of the inlet channel 341.

With the above configuration, when the fuel passes through the inlet channel 341, the liquid film first becomes thin. The fuel of which liquid film has been thinned in the inlet channel 341 in advance becomes thinner in the outlet channel 351 having a larger diameter expansion ratio than that of the inlet channel 341. For that reason, the fuel injected from the outflow port 331 is atomized because the liquid film becomes thin.

More specifically, as described above, when the fuel flows to a position where the degree of expanding the diameter of the outlet channel 351 is larger than the degree of expanding the diameter of the inlet channel 341, a vortex is generated in the outlet channel 351 due to separation of the fuel from the inner wall of the injection hole 311. The fuel is pulled by a negative pressure of the vortex to the outlet-channel-forming portion 351*a*, to thereby thin the liquid film of the fuel.

In particular, when the diameter expansion ratio of the outlet channel 351 gradually increases along a direction from the inflow port 321 to the outflow port 331, the vortex is liable to occur. In other words, the liquid film of the fuel becomes thin.

(Fourth Embodiment)

In the first embodiment and the second embodiment, the diameter expansion ratio which is the degree of expanding the diameter D2 of the outlet channel 351 is set to be larger along a direction from the inflow port 321 toward the outflow port 331.

Figure 10:
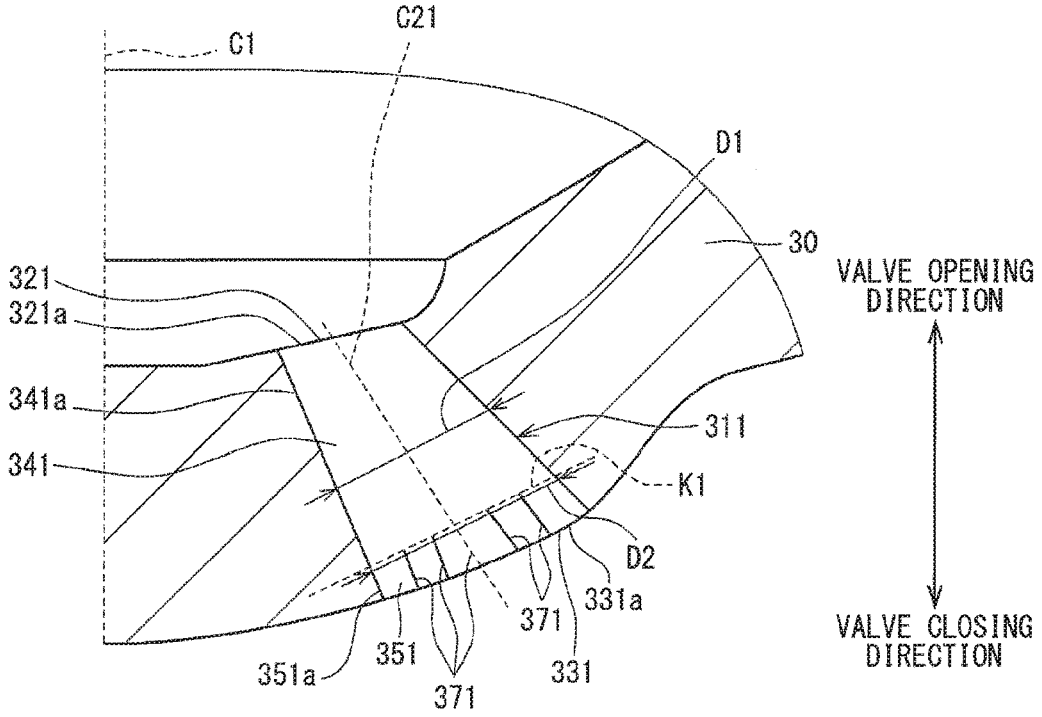
FIG. 10 is an enlarged cross-sectional view of a vicinity of an injection hole in a fuel injection device according to a fourth embodiment of the present disclosure.

On the contrary, in the fourth embodiment of the present disclosure, as illustrated in FIG. 10, the diameter expansion ratio which is the degree of expanding the diameter D2 of the outlet channel 351 is kept constant.

(Fifth Embodiment)

In the first embodiment and the second embodiment, the diameters of the inlet channel 341 and the outlet channel 351 are expanded along a direction from the inflow port 321 toward the outflow port 331.

Figure 11:
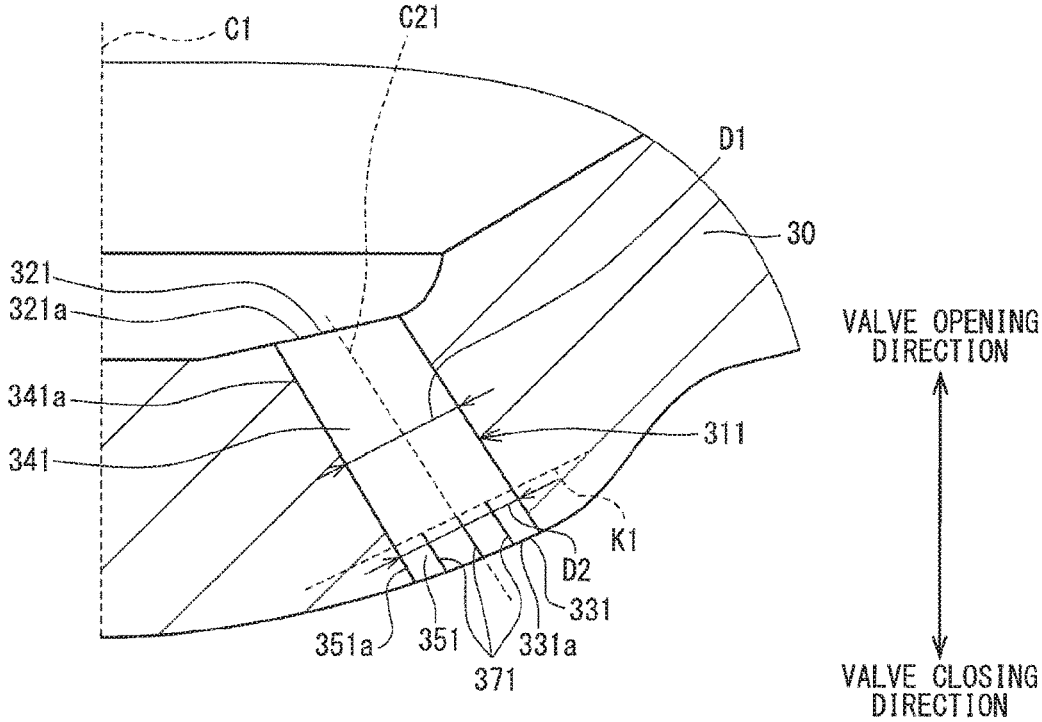
FIG. 11 is an enlarged cross-sectional view of a vicinity of an injection hole in a fuel injection device according to a fifth embodiment of the present disclosure.

On the contrary, in the fifth embodiment of the present disclosure, as illustrated in FIG. 11, the diameter D1 of the inlet channel 341 and the diameter D2 of the outlet channel 351 are kept constant (identical) between the inflow port 321 and the outflow port 331.

(Sixth Embodiment)

Figure 12:
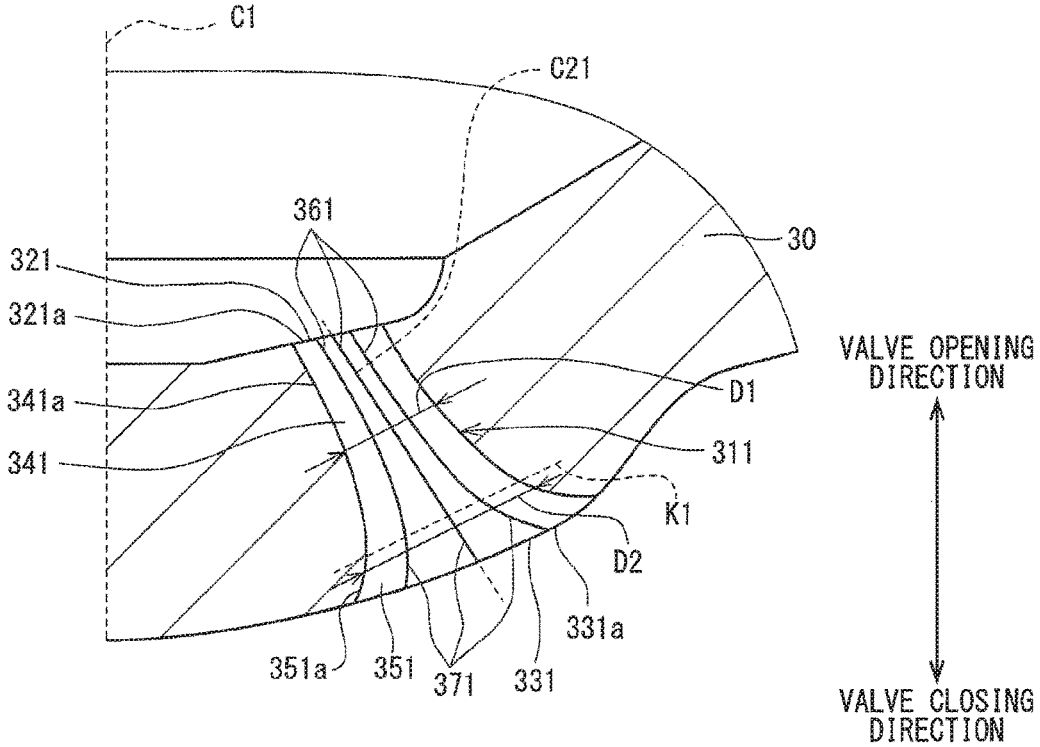
FIG. 12 is an enlarged cross-sectional view of a vicinity of an injection hole in a fuel injection device according to a sixth embodiment of the present disclosure.

In a sixth embodiment of the present disclosure, as illustrated in FIG. 12, grooves 361 are also formed in an inlet-channel-forming portion 341*a*. With the above configuration, the fuel tends to flow along the grooves 361 of the inlet-channel-forming portion 341*a*, For that reason, the liquid film of fuel becomes further thinner. Therefore, the atomization of the fuel injected from the outflow port 331 is further atomized.

In addition, as illustrated in FIG. 12, in the inlet channel 341 and the outlet channel 351, the inlet-channel-forming portion 341*a* and the outlet-channel-forming portion 351*a* are formed to increase the diameter expansion ratio which is the degree of expanding the diameter of the flow channel along a direction from the inflow port 321 to the outflow port 331.

(Seventh Embodiment)

Figure 13:
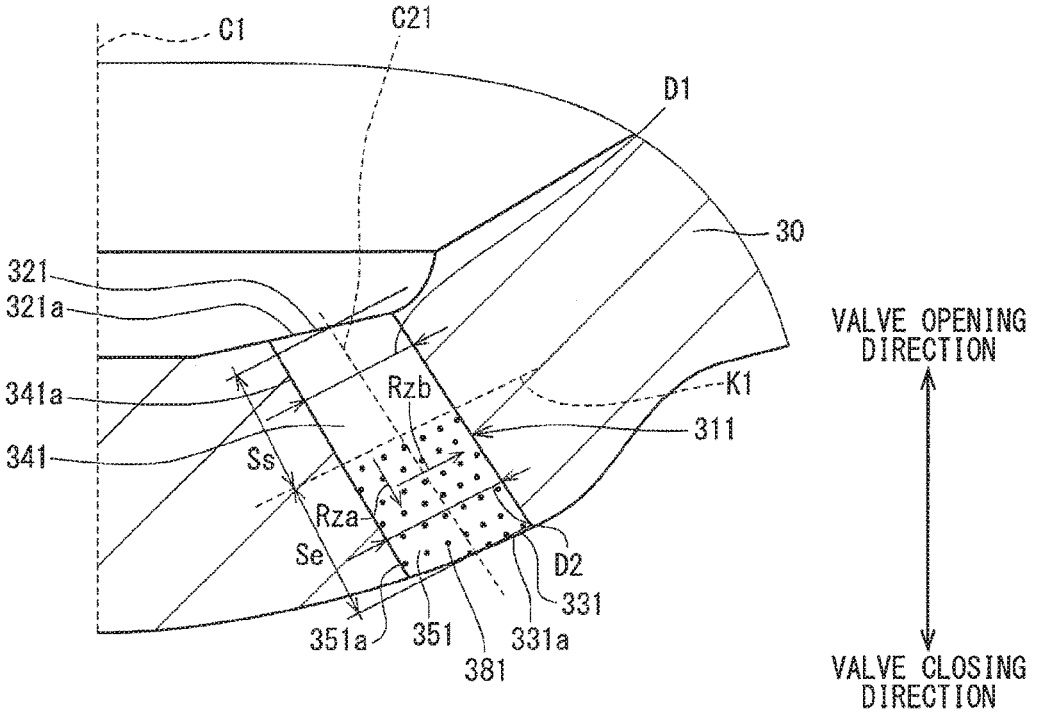
FIG. 13 is an enlarged cross-sectional view of a vicinity of an injection hole in a fuel injection device according to a seventh embodiment of the present disclosure.

A part of a fuel injection device according to a seventh embodiment of the present disclosure is illustrated in FIG. 13.

In the seventh embodiment, a diameter D1 of an inlet channel 341 and a diameter 02 of an outlet channel 351 are kept constant (identical) between an inflow port 321 and an outflow port 331.

Figure 14:
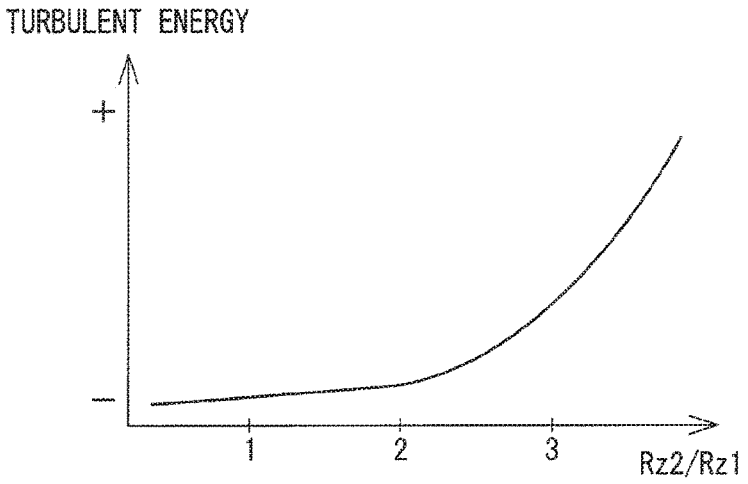
FIG. 14 is a diagram illustrating a relationship between a surface roughness of an inlet-channel-forming portion as well as a surface roughness of an outlet-channel-forming portion, and a turbulent energy of an injected fuel.

In the seventh embodiment, multiple convex portions 381 are formed on an outlet-channel-forming portion 351*a*. In this example, when it is assumed that a surface roughness of the inlet-channel-forming portion 341*a* is Rz1 and a surface roughness of the outlet-channel-forming portion 351*a* is Rz2, the inlet-channel-forming portion 341*a* and the outlet-channel-forming portion 351*a* are formed to satisfy Rz2>Rz1 and Rz2/Rz1≥2. In other words, the surface roughness Rz2 of the outlet-channel-forming portion 351*a* is larger than, that is, twice or more as large as the surface roughness Rz1 of the inlet-channel-forming portion 341*a*. As illustrated in FIG. 14, when Rz2/Rz1 is 2 or more, a turbulent energy of the fuel injected from the injection holes becomes remarkably large. Therefore, the turbulent energy of the fuel injected from the injection hole 311 according to the present embodiment is large.

When it is assumed that the surface roughness of the outlet-channel-forming portion 351*a* along a direction from the inflow port 321 to the outflow port 331 is Rza and the surface roughness of the outlet-channel-forming portion 351*a* in a circumferential direction is Rzb, the outlet-channel-forming portion 351*a* is formed so as to satisfy a relationship of Rza<Rzb. In other words, in the outlet-channel-forming portion 351*a*, the surface roughness Rzb in the circumferential direction is larger than the surface roughness Rza along a direction from the inflow port 321 to the outflow port 331.

Also, when it is assumed that a length of the injection hole 311 of the inlet-channel-forming portion 341*a* in the central axis C21 direction is Ss, and a length of the outlet-channel-forming portion 351*a* in the central axis C21 direction is Se, the inlet-channel-forming portion 341*a* and the outlet-channel-forming portion 351*a* are formed to satisfy a relationship of Se/Ss=1. In other words, in the present embodiment, Ss is equal to Se. In this example, the length of the inlet-channel-forming portion 341*a* in the direction of the central axis C21 represents a length of the central axis C21 from the inflow port 321 to the outlet channel 351, and the length of the outlet-channel-forming portion 351*a* in the direction of the central axis C21 represents a length of the central axis C21 from the inlet channel 341 to the outflow port 331.

As described above, according to the present embodiment, the surface roughness Rz2 of the outlet-channel-forming portion 351*a* is larger than the surface roughness Rz1 of the inlet-channel-forming portion 341*a*. For that reason, the flow rate of the fuel can be increased in the inlet channel 341, and the energy of the fuel having the increased flow rate can be effectively converted to the turbulent energy in the outlet channel 351. Therefore, with an improvement in the turbulent energy, the fuel injected from the injection holes 311 can be atomized, and a fuel draining property can be improved.

In addition, according to the present embodiment, in the outlet-channel-forming portion 351*a*, the surface roughness Rzb in the circumferential direction is larger than the surface roughness Rza along a direction from the inflow port 321 to the outflow port 331. For that reason, in the injection hole 311, the turbulent energy can be improved in the outlet channel 351 in a state where the directivity of the fuel is secured in the inlet channel 341.

In addition, the surface roughness Rz2 of the outlet-channel-forming portion 351*a* is twice or more as large as the surface roughness Rz1 of the inlet-channel-forming portion 341*a*. For that reason, the turbulent energy of the fuel injected from the injection hole 311 can be increased.

In the present embodiment, the atomization of the fuel injected from the injection hole 311 and a reduction in penetration force can be performed.

(Eighth Embodiment)

Figure 15:
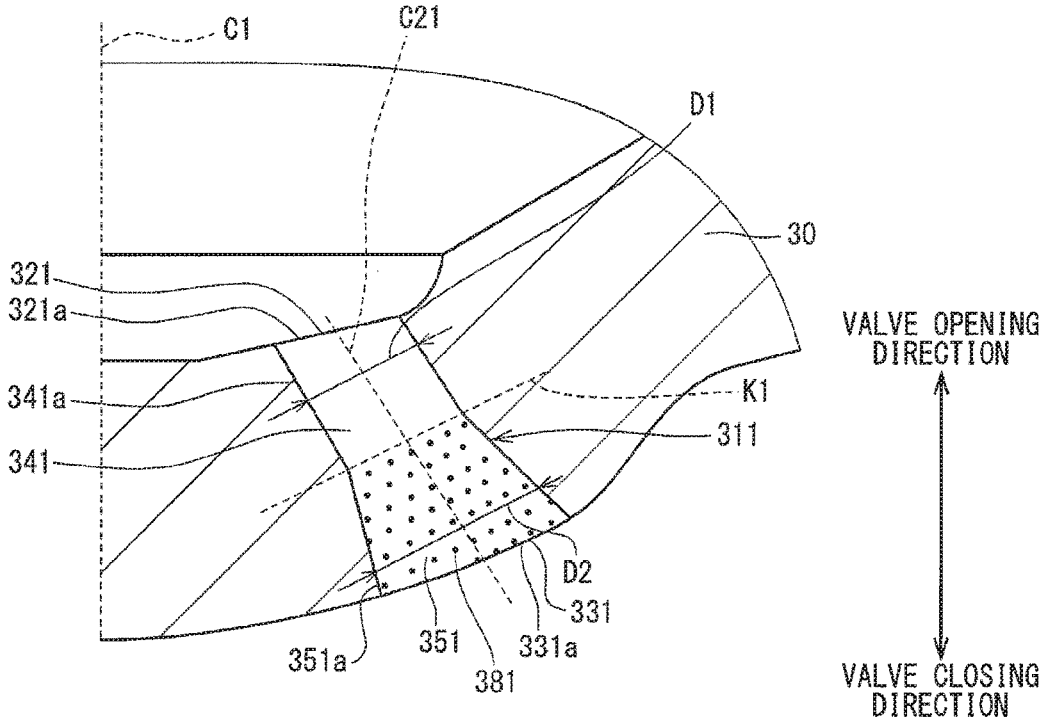
FIG. 15 is an enlarged cross-sectional view of a vicinity of an injection hole in a fuel injection device according to an eighth embodiment of the present disclosure.

A part of a fuel injection device according to an eighth embodiment of the present disclosure is illustrated in FIG. 15. According to the eighth embodiment, shapes of an outlet-channel-forming portion 351*a* are different from that in the seventh embodiment.

According to the eighth embodiment, the outlet-channel-forming portion 351*a* is formed in a tapered shape so that the diameter of the outlet-channel-forming portion 351*a* is expanded at a constant diameter expansion ratio along a direction from the inflow port 321 toward the outflow port 331. Hence, an area of the outflow port 331 is larger than an area of the inflow port 321.

The eighth embodiment is the same as the seventh embodiment except for features described above.

As described above, according to the present embodiment, the area of the outflow port 331 is larger than the area of the inflow port 321, In order to improve the speed of fuel in the injection hole 311, it is advantageous that a contact area between the fuel and the wall surface (inlet-channel-forming portion 341*a*) is small in the inlet channel 341. On the other hand, in the outlet channel 351, when the contact area between the fuel and the wall surface (the outlet-channel-forming portion 351*a*) is large, there is advantageous in that the turbulent energy is improved by the convex portions 381. In the present embodiment, the area of the outflow port 331 is set to be larger than the area of the inflow port 321, and the area of the outlet-channel-forming portion 351*a* can be increased while the area of the inlet-channel-forming portion 341*a* is reduced. Therefore, both of an improvement in the speed of the fuel in the injection hole 311 and an improvement in the turbulent energy can be performed. Hence, the atomization of the fuel injected from the injection hole 311 and a reduction in penetration force can be performed.

(Ninth Embodiment)

Figure 16:
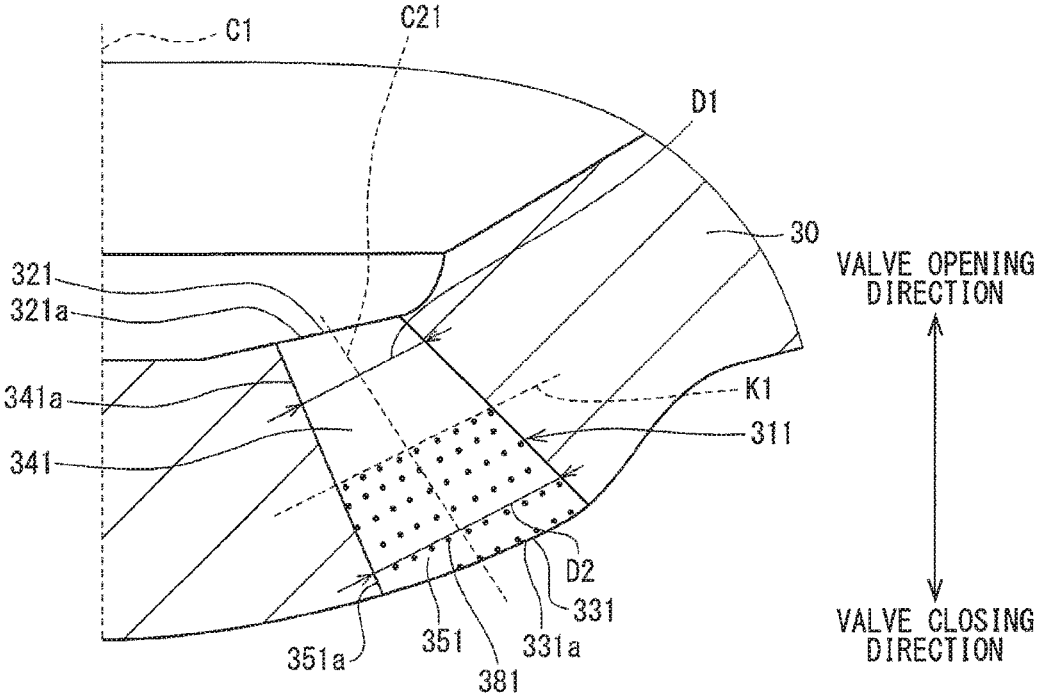
FIG. 16 is an enlarged cross-sectional view of a vicinity of an injection hole in a fuel injection device according to a ninth embodiment of the present disclosure.

A part of a fuel injection device 1 according to a ninth embodiment of the present disclosure is illustrated in FIG. 16. In the ninth embodiment, shapes of an inlet-channel-forming portion 341*a* and an outlet-channel-forming portion 351*a* are different from those of the eighth embodiment, According to the ninth embodiment, the inlet-channel-forming portion 341*a* and the outlet-channel-forming portion 351*a* are formed in a tapered shape so as to expand the diameters of the inlet-channel-forming portion 341*a* and the outlet-channel-forming portion 351*a* at a constant diameter expansion ratio along a direction from the inflow port 321 toward the outflow port 331. In other words, in the present embodiment, an inner diameter of the injection hole 311 is continuously enlarged along a direction from the inflow port 321 toward the outflow port 331. In more detail, a diameter expansion ratio which is a degree of expanding the diameter of the inlet channel 341 and a diameter expansion ratio which is a degree of expanding the diameter of the outlet channel 351 are the same as each other at a boundary (K1) between the inlet channel 341 and the outlet channel 351. An area of the outflow port 331 is larger than an area of the inflow port 321.

The ninth embodiment is the same as the eighth embodiment except for the features described above.

As described above, according to the present embodiment, the diameter of each of the inlet channel 341 and the outlet channel 351 is expanded along a direction from the inflow port 321 toward the outflow port 331. A diameter expansion ratio which is a degree of expanding the diameter of the inlet channel 341 and a diameter expansion ratio which is a degree of expanding the diameter of the outlet channel 351 are the same as each other at a boundary between the inlet channel 341 and the outlet channel 351. For that reason, a rapid change in diameter can be eliminated between the inlet channel 341 and the outlet channel 351, the fuel is evenly spread and a variation in a flow-in direction that affects directivity can be reduced.

(Tenth Embodiment)

Figure 17:
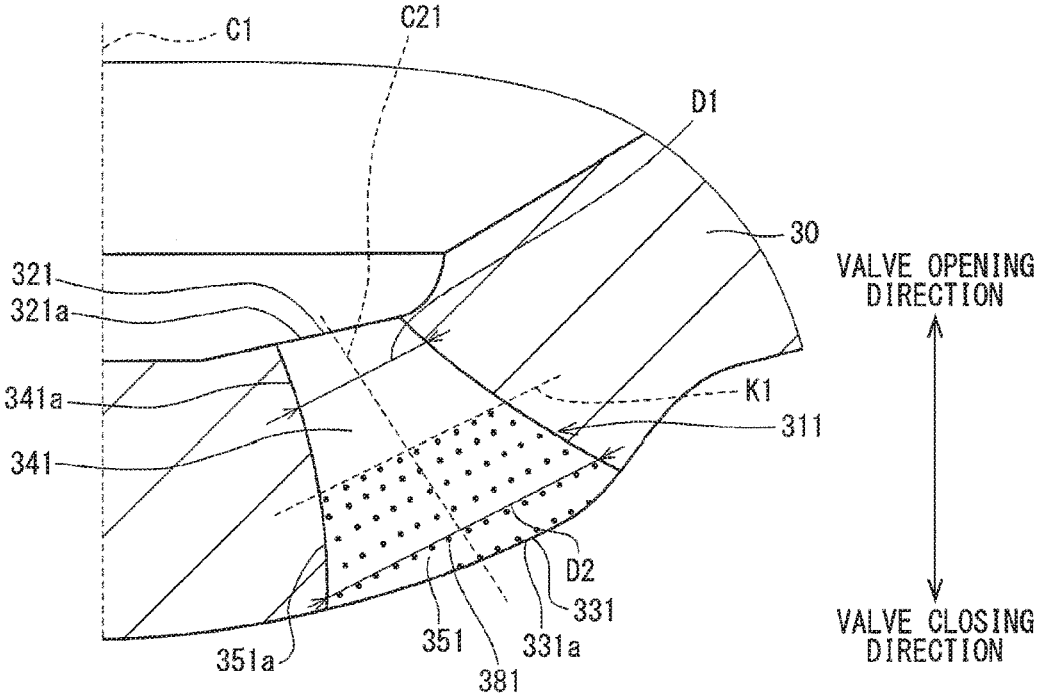
FIG. 17 is an enlarged cross-sectional view of a vicinity of an injection hole in a fuel injection device according to a tenth embodiment of the present disclosure.

A part of a fuel injection device according to a tenth embodiment of the present disclosure is illustrated in FIG. 17. According to the tenth embodiment, shapes of an inlet-channel-forming portion 341*a* and an outlet-channel-forming portion 351*a* are different from those of the ninth embodiment.

According to the tenth embodiment, the inlet-channel-forming portion 341*a* and the outlet-channel-forming portion 351*a* are formed so that the diameter expansion ratios of the inlet-channel-forming portion 341*a* and the outlet-channel-forming portion 351*a* are gradually expanded along a direction from the inflow port 321 toward the outflow port 331. Therefore, in the inlet-channel-forming portion 341*a* and the outlet-channel-forming portion 351*a*, a contour of the inner wall in a cross section taken along a virtual plane including the central axis C21 of the injection hole 311 is formed in a curved shape away from the central axis C21 from the inflow port 321 toward the outflow port 331. An area of the outflow port 331 is larger than an area of the inflow port 321.

The tenth embodiment is the same as the ninth embodiment except for the features described above.

In the tenth embodiment, as in the ninth embodiment, both of an improvement in the speed of the fuel in the injection hole 311 and an improvement in the turbulent energy can be performed.

(Eleventh Embodiment)

Figure 18:
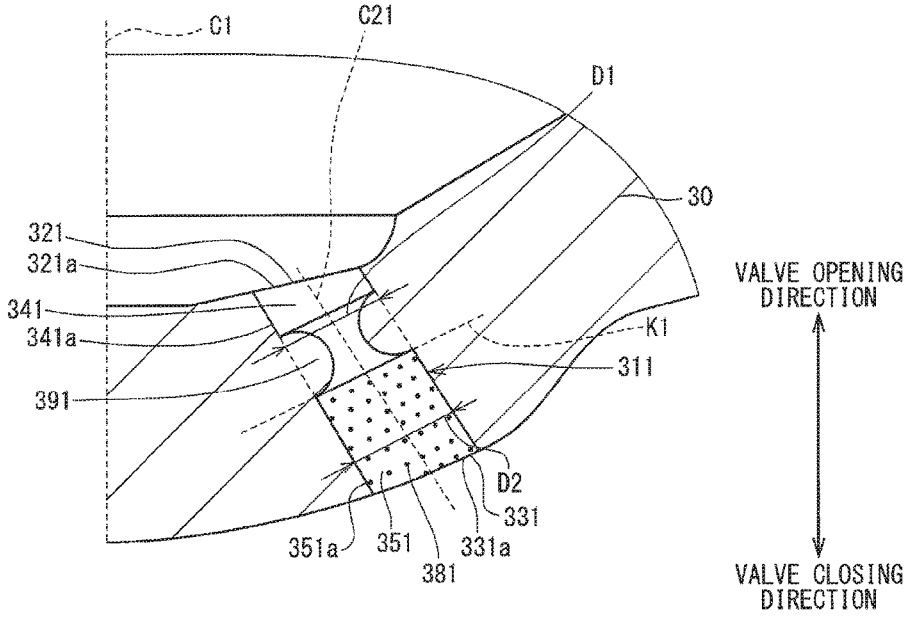
FIG. 18 is an enlarged cross-sectional view of a vicinity of an injection hole in a fuel injection device according to an eleventh embodiment of the present disclosure.

A part of a fuel injection device according to an eleventh embodiment of the present disclosure is illustrated in FIG. 18. The eleventh embodiment is different in the shape of the body portion 30 from the seventh embodiment.

In the eleventh embodiment, the body portion 30 has a throttle portion 391. The throttle portion 391 is formed in an annular shape and is formed on the inflow port 321 with respect to the outlet-channel-forming portion 351*a*. The throttle portion 391 is integrally formed with the inlet-channel-forming portion 341*a* so that an outer edge portion of the throttle portion 391 is connected to the inlet-channel-forming portion 341*a*. In the throttle portion 391, an area of a central opening is smaller than an area of the inflow port 321.

The eleventh embodiment is the same as the seventh embodiment except for the features described above.

As described above, in the present embodiment, the body portion 30 has the throttle portion 391 formed on the inflow port 321 with respect to the outlet-channel-forming portion 351*a* and having an area of a central opening smaller than an area of the inflow port 321. For that reason, the flow rate of the fuel passing through the opening of the throttle portion 391 increases. As a result, the fuel having the increased flow rate is introduced into the outlet channel 351 large in the surface roughness, thereby being capable of more effectively improving the turbulent energy.

(Twelfth Embodiment)

Figure 19:
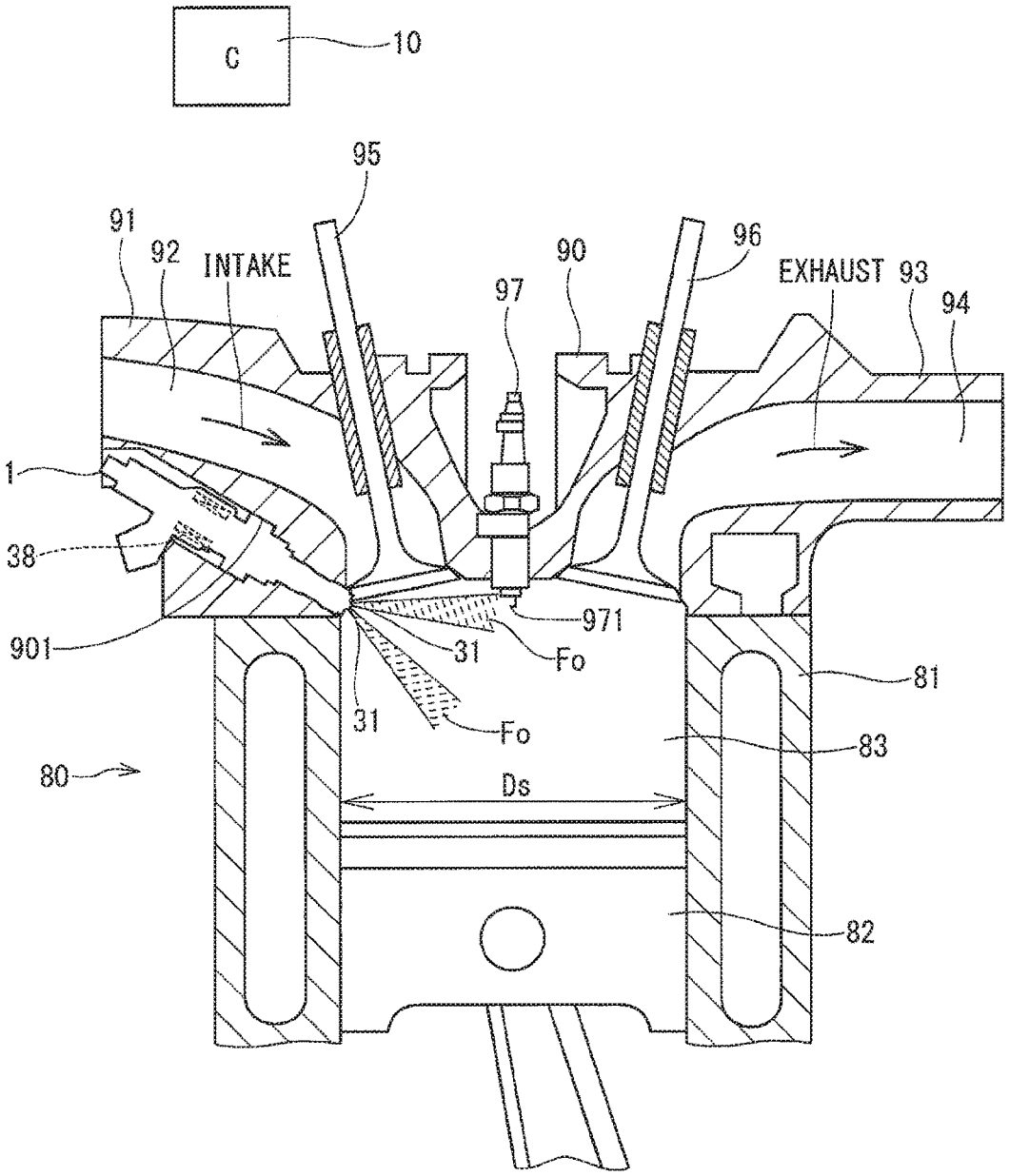
FIG. 19 is a diagram illustrating a state in which a fuel injection device is applied to an internal combustion engine according to a twelfth embodiment of the present disclosure.

A fuel injection device according to a twelfth embodiment of the present disclosure is illustrated in FIG. 19.

In the twelfth embodiment, a fuel injection device 1 is applied to, for example, a gasoline engine (hereinafter simply referred to as "engine") 80 as an internal combustion engine, injects gasoline as a fuel and supplies the gasoline to the engine 80 (refer to FIG. 19).

As illustrated in FIG. 19, the engine 80 includes a cylindrical cylinder block 81, a piston 82, a cylinder head 90, an intake valve 95, an exhaust valve 96, and the like. The piston 82 is disposed so as to reciprocate inside of the cylinder block 81. The cylinder head 90 is made of aluminum, for example, and is configured so as to close an opening end of the cylinder block 81. A combustion chamber 83 is defined by an inner wall of the cylinder block 81, a wall surface of the cylinder head 90, and the piston 82. A volume of the combustion chamber 83 increases or decreases with a reciprocating movement of the piston 82.

The cylinder head 90 has an intake manifold 91 and an exhaust manifold 93. An intake air passage 92 is defined in the intake manifold 91. One end of the intake air passage 92 is open to an atmosphere and the other end of the intake air passage 92 is connected to the combustion chamber 83. The intake air passage 92 leads an air drawn in from the atmosphere (hereinafter referred to as "intake air") to the combustion chamber 83.

An exhaust passage 94 is defined in the exhaust manifold 93. One end of the exhaust passage 94 is connected to the combustion chamber 83, and the other end of the exhaust passage 94 is opened to the atmosphere. The exhaust passage 94 leads the air containing a combustion gas (hereinafter referred to as "exhaust gas") generated in the combustion chamber 83 to the atmosphere.

The intake valve 95 is disposed in the cylinder head 90 so that the intake valve 95 can reciprocate by rotation of a cam of a driven shaft that rotates in conjunction with a driving shaft not shown. The intake valve 95 reciprocates so as to be opened and closed between the combustion chamber 83 and the intake air passage 92. The exhaust valve 96 is disposed in the cylinder head 90 so as to reciprocate by the rotation of the cam. The exhaust valve 96 reciprocates so as to be opened and closed between the combustion chamber 83 and the exhaust passage 94.

The fuel injection device 1 is mounted on the cylinder block 81 of the intake air passage 92 of the intake manifold 91. The fuel injection device 1 is arranged so that an axis of the fuel injection device 1 is inclined with respect to the axis of the combustion chamber 83 or has a twisted relationship with the axis of the combustion chamber 83. In the present embodiment, the fuel injection device 1 is mounted on the engine 80.

An ignition plug 97 as an ignition device is disposed between the intake valve 95 and the exhaust valve 96 in the cylinder head 90, that is, at a position corresponding to a center of the combustion chamber 83.

The fuel injection device 1 is disposed in a hole portion 901 of the cylinder head 90 so that the multiple injection holes 31 are exposed in the combustion chamber 83. A fuel pressurized to a fuel injection pressure by a fuel pump not shown is supplied to the fuel injection device 1. A conical spray Fo is injected into the combustion chamber 83 from the multiple injection holes 31 of the fuel injection device 1. The ignition plug 97 has an electric discharge portion 971 exposed in the combustion chamber 83, and can ignite the fuel (spray Fo) injected from the injection holes 31 by the discharge of the electric discharge portion 971.

Figure 20:
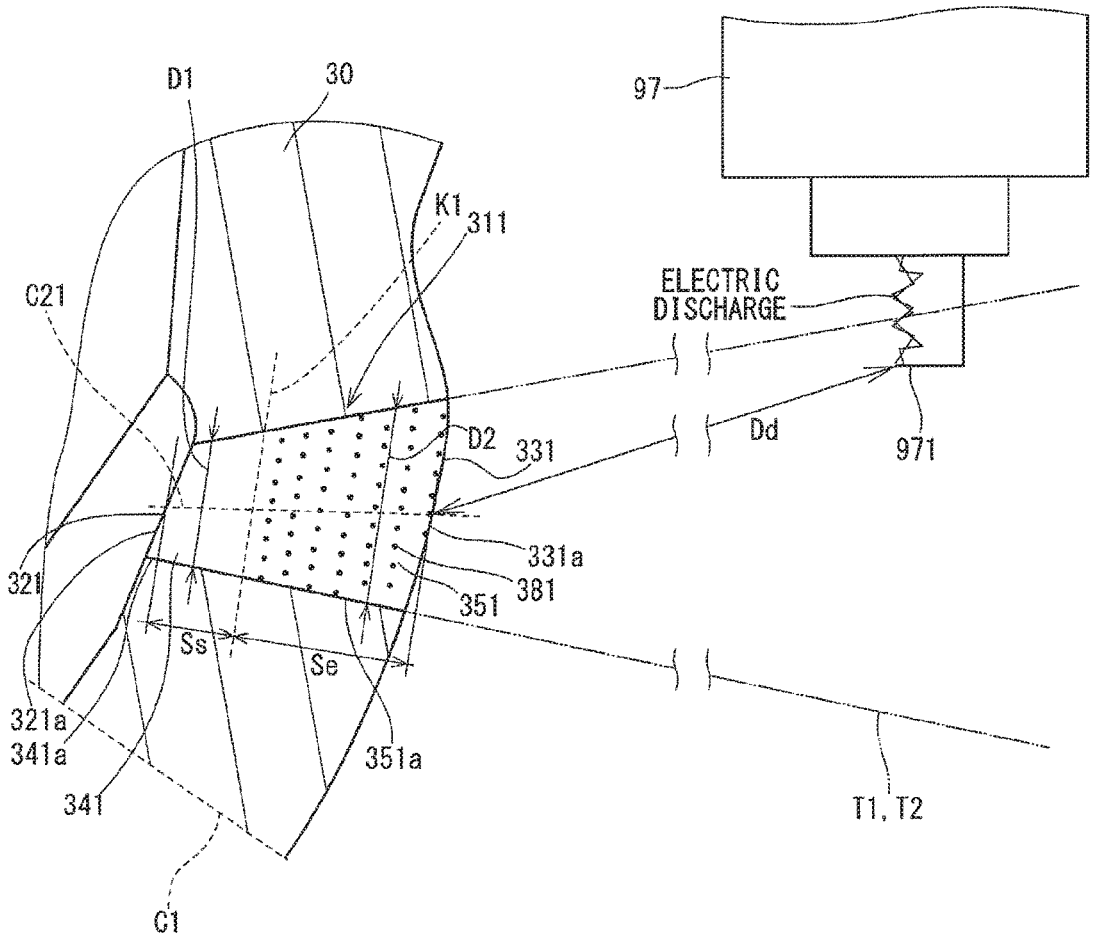
FIG. 20 is a diagram illustrating a relationship between the fuel injection device and the ignition device according to the twelfth embodiment of the present disclosure.

According to the present embodiment, each of the injection holes 31 (311) is formed to locate at least a part of the electric discharge portion 971 inside of an outlet virtual surface T1 that extends in a cylindrical shape in the central axis C21 direction of the injection hole 311 along an inner wall of the end portion of the outlet-channel-forming portion 351*a* on the outflow port 331 in a state where the fuel injection device 1 is disposed in the engine 80 (refer to FIG. 20).

In addition, according to the present embodiment, each of the injection holes 31 (311) is formed to locate at least a part of the electric discharge portion 971 inside of an inlet virtual surface T2 that extends in a cylindrical shape in the central axis C21 direction of the injection hole 311 along an inner wall of the end portion of the inlet-channel-forming portion 341*a* on the outlet-channel-forming portion 351*a* in a state where the fuel injection device 1 is disposed in the engine 80 (refer to FIG. 20).

In addition, according to the present embodiment, when a diameter of the combustion chamber 83 is Ds and a distance between a center of the outflow port 331 and the electric discharge portion 971 in a state where the fuel injection device 1 is disposed in the engine 80 is Dd, the injection hole 31 (311) is defined to satisfy a relationship of $Dd \leq Ds/2$ (refer to FIGS. 19 and 20).

Also, according to the present embodiment, when a length of the inlet-channel-forming portion 341*a* in the axial direction is Ss, and a length of the outlet-channel-forming portion 351*a* in the axial direction is Se, the injection holes 31 (311) are defined to satisfy a relationship of $Se/Ss \geq Ds/Dd$ (refer to FIGS. 19 and 20). Incidentally, according to the present embodiment, for example, $Ds/Dd=2$ and $Se/Ss=2$ are satisfied.

In addition, according to the present embodiment, the coil 38 is surrounded by an inner wall of the cylinder head 90 forming the hole portion 901 in a state where the fuel injection device 1 is disposed in the hole portion 901 (refer to FIG. 19).

In addition, according to the present embodiment, the fuel injection device 1 includes a movable core 47 that is movable relative to the needle 40, and disposed to be reciprocatable in the housing 20 together with the needle 40 (refer to FIG. 1).

In addition, according to the present embodiment, the fuel injection device 1 includes a control unit 10 that controls an electric power to be supplied to the coil 38 to cause the movement of the needle 40 to a side opposite to the valve seat 34 to be controllable. The control unit 10 can execute a partial control for controlling the movement of the needle 40 on the side opposite to the valve seat 34 so as to enable a partial movement in a movable range of the needle 40 (refer to FIGS. 1 and 19).

As described above, according to the present embodiment, each of the injection holes 31 (311) is formed to locate at least a part of the electric discharge portion 971 inside of an outlet virtual surface T1 that extends in a cylindrical shape in the central axis C21 direction of the injection hole 311 along an inner wall of the end portion of the outlet-channel-forming portion 351*a* on the outflow port 331 in a state where the fuel injection device 1 is disposed in the engine 80 (refer to FIG. 20). Since the fuel injection device 1 according to the present embodiment has an effect of lowering the penetration force of the fuel (spray Fo) injected from the injection holes 31, the spray Fo can be held in the vicinity of the electric discharge portion 971 of the ignition plug 97. For that reason, a fuel deficiency in the vicinity of the electric discharge portion 971 (ignition point) can be suppressed, and ignition can be performed with a small amount of fuel. As a result, a wasteful fuel injection can be suppressed, and a fuel consumption can be improved while reducing soot.

In addition, according to the present embodiment, each of the injection holes 31 (311) is formed to locate at least a part of the electric discharge portion 971 inside of an inlet virtual surface T2 that extends in a cylindrical shape in the central axis C21 direction of the injection hole 311 along an inner wall of the end portion of the inlet-channel-forming portion 341*a* on the outlet-channel-forming portion 351*a* in a state where the fuel injection device 1 is disposed in the engine 80 (refer to FIG. 20). For that reason, the spray Fo can be held closer to the electric discharge portion 971 of the ignition plug 97. As a result, the wasteful fuel injection can be further suppressed, and the fuel consumption can be further improved while reducing soot.

In addition, according to the present embodiment, when a diameter of the combustion chamber 83 is Ds and a distance between a center of the outflow port 331 and the electric discharge portion 971 in a state where the fuel injection device is disposed in the engine 80 is Dd, the injection hole 31 (311) is defined to satisfy a relationship of Dd≤Ds/2 (refer to FIGS. 19 and 20), In other words, in the present embodiment, the distance (Dd) between the injection holes 31 (311) and the electric discharge portion 971 is half or less than half, of the diameter (Ds) of the combustion chamber 83. Since the fuel injection device 1 according to the present embodiment has an effect of lowering the penetration force of the fuel (spray Fo) injected from the injection hole 31, it is desirable that the distance (Dd) between the injection holes 31 (311) and the electric discharge portion 971 is small as in the present embodiment.

Also, according to the present embodiment, when a length of the inlet-channel-forming portion 341*a* in the axial direction is Ss, and a length of the outlet-channel-forming portion 351*a* in the axial direction is Se, the injection holes 31 (311) are defined to satisfy a relationship of Se/Ss≥Ds/Dd (refer to FIGS. 19 and 20). In other words, in the present embodiment, the length Ss in the axial direction of the inlet-channel-forming portion 341*a* and the length Se in the axial direction of the outlet-channel-forming portion 351*a* are set so that the penetration force of the fuel spray Fo decreases as Dd is smaller than Ds, according to a relationship between the distance Dd between the center of the outflow port 331 and the electric discharge portion 971 and the diameter Ds of the combustion chamber 83. As a result, the fuel spray Fo can be held in the vicinity of the electric discharge portion 971 according to the placement of the fuel injection device 1 and the ignition plug 97.

In addition, according to the present embodiment, the coil 38 is surrounded by an inner wall of the cylinder head 90 forming the hole portion 901 in a state where the fuel injection device 1 is disposed in the hole portion 901 (refer to FIG. 19). Since the fuel injection device 1 according to the present embodiment is disposed in the engine 80 so that the coil 38 is surrounded by the inner wall of the cylinder head 90, when a current flows through the coil 38, the fuel injection device 1 may be affected by magnetism from the cylinder head. For that reason, there is a possibility that the fuel injection may vary among individuals of the fuel injection devices 1 and between the cylinder blocks 81 (cylinders). Further, the distance between the coil 38 and the inner wall of the cylinder head 90 changes due to a secular change, vibration of the engine 80, or the like, and the variation may become more conspicuous. As a result, the amount of fuel injected from the fuel injection device 1 varies, and the amount of fuel supplied to the vicinity of the electric discharge portion 971 (ignition point) varies, possibly resulting in unstable ignitability. However, in the fuel injection device 1 according to the present embodiment, the atomized fuel can be disposed in the vicinity of the electric discharge portion 971 (ignition point). In addition, since the penetration force of the fuel spray Fo can be reduced, the fuel spray Fo can be located in the vicinity of the ignition point. Therefore, a uniform fuel spray Fo can be supplied to the vicinity of the ignition point, and stable ignition can be maintained even if the amount of injected fuel varies.

In addition, according to the present embodiment, the fuel injection device 1 includes a movable core 47 that is movable relative to the needle 40, and disposed to be reciprocatable in the housing 20 together with the needle 40 (refer to FIG. 1). As in the present embodiment, when the needle 40 and the movable core 47 are united, the movable core 47 moves to the valve seat 34 even after the needle 40 abuts (closes) against the valve seat 34. As a result, the risk of secondary injection dramatically increases. Since the fuel injected by the secondary injection is injected in a state where the needle 40 cannot be fully raised, the fuel is injected in a region where the pressure loss is very high. For that reason, since it is difficult to atomize the fuel, and the fuel is injected later than an assumed injection timing, an evaporation time of the fuel is also short. This causes local rich in a combustion stroke, and the amount of soot may increase. However, in the fuel injection device 1 according to the present embodiment, even if the fuel pressure is low, the fuel can be atomized efficiently by the injection holes 31, as a result of which the amount of soot generated in the secondary injection can be reduced.

In addition, according to the present embodiment, the fuel injection device 1 includes a control unit 10 that controls an electric power to be supplied to the coil 38 to cause the movement of the needle 40 to a side opposite to the valve seat 34 to be controllable. The control unit 10 can execute a partial control for controlling the movement of the needle 40 on the side opposite to the valve seat 34 so as to enable a partial movement in a movable range of the needle 40 (refer to FIGS. 1 and 19). When partial control is performed as in the present embodiment, since the needle 40 cannot be sufficiently raised, the pressure loss of fuel to be injected is large and the atomization is difficult as described above. This causes local rich in a combustion stroke, and the amount of soot may increase. However, in the fuel injection device 1 according to the present embodiment, even if the fuel pressure is low, the fuel can be efficiently atomized by the injection holes 31, as a result of which the amount of soot generated in the partial control can be reduced.

(Thirteenth Embodiment)

Figure 21:
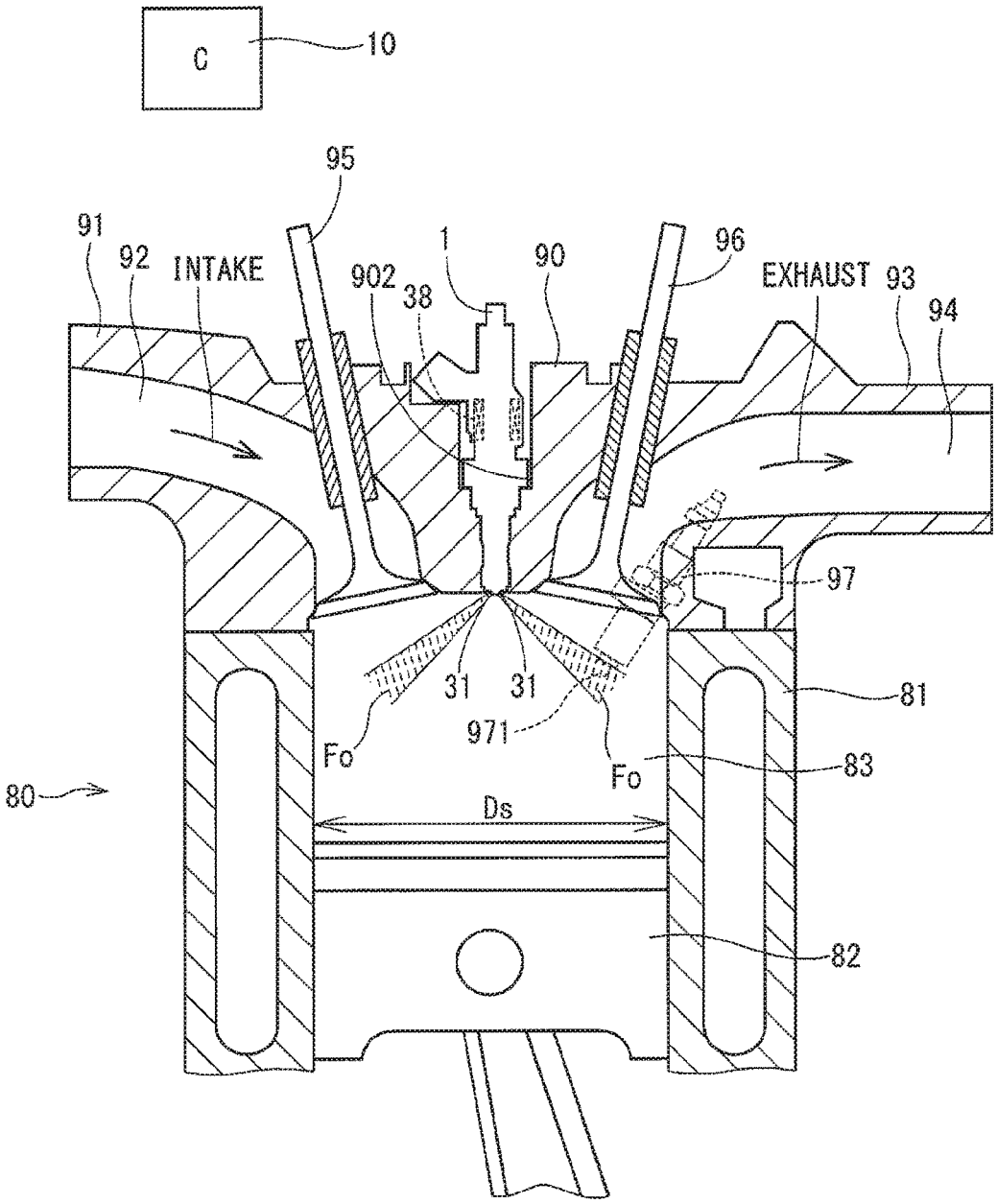
FIG. 21 is a diagram illustrating a state in which a fuel injection device is applied to an internal combustion engine according to a thirteenth embodiment of the present disclosure.

A fuel injection device according to a thirteenth embodiment of the present disclosure is illustrated in FIG. 21. The thirteenth embodiment is different in the placement of a fuel injection device 1 from the twelfth embodiment.

In the thirteenth embodiment, the fuel injection device 1 is mounted between an intake valve 95 and an exhaust valve 96 in a cylinder head 90, that is, at a position corresponding to a center of the combustion chamber 83. The fuel injection device 1 is arranged so that an axis of the fuel injection device 1 is placed substantially in parallel to an axis of a combustion chamber 83 or substantially coincides with the axis of the combustion chamber 83. In the present embodiment, the fuel injection device 1 is mounted on a so-called center of the engine 80. The cylinder head 90 is provided with an ignition plug 97 as an ignition device.

The fuel injection device 1 is disposed in a hole portion 902 of the cylinder head 90 so that the multiple injection holes 31 are exposed in the combustion chamber 83. The ignition plug 97 has an electric discharge portion 971 exposed in the combustion chamber 83, and can ignite the fuel (spray Fo) injected from the injection holes 31 by the discharge of the electric discharge portion 971.

In the thirteenth embodiment, a positional relationship between the injection holes 31 (311) and the electric discharge portion 971, a relationship between a distance Dd and a diameter Ds of the combustion chamber 83, a relationship between a length Ss in the axial direction of the inlet-channel-forming portion 341*a* and an axial length Se of the outlet-channel-forming portion 351*a*, and so on are the same as those of the twelfth embodiment. Similarly to the twelfth embodiment, according to the thirteenth embodiment, the coil 38 is surrounded by an inner wall of the cylinder head 90 forming the hole portion 902 in a state where the fuel injection device 1 is disposed in the hole portion 902. Therefore, the thirteenth embodiment can obtain the same effects as those in the twelfth embodiment.

(Other Embodiments)

In the second embodiment and the like described above, an example in which the multiple convex portions 381 are formed in the outlet-channel-forming portion 351*a* has been described. On the other hand, in another embodiment of the present disclosure, multiple concave portions may be defined in an outlet-channel-forming portion 351*a* of the injection hole, and a surface roughness of the outlet-channel-forming portion 351*a* may be set to be larger than the surface roughness of an inlet-channel-forming portion 341*a*.

In the first embodiment described above, an example in which the multiple grooves 371 extending from the inflow port 321 to the outflow port 331 are formed in the outlet-channel-forming portion 351*a* in the circumferential direction has been described. On the contrary, in another embodiment of the present disclosure, multiple grooves extending in the circumferential direction may be formed in the outlet-channel-forming portion 351*a* from the inflow port 321 to the outflow port 331, and the surface roughness of the outlet-channel-forming portion may be set to be larger than the surface roughness of the inlet-channel-forming portion 341*a*.

In the first embodiment described above, the interval D3 between the respective grooves 371 is set to be wider along a direction from the inflow port 321 toward the outflow 331 port, and the depth DE1 of the grooves 371 is set to be deeper along a direction from the inflow port 321 toward the outflow port 331. In addition, the width W1 of the grooves 371 is set to be wider along a direction from the inflow port 321 toward the outflow port 331. In contrast, in other embodiments of the present disclosure, the interval between the respective grooves, the depth of the grooves, and the width of the grooves may be set in any way.

Further, the fuel injection device 1 can also be applied to a fuel injection device for a diesel engine. Further, the fuel injection device 1 can also be applied to fuel injection valves other than the direct injection type, such as a port injection type.

As described above, the present disclosure is not limited to the above embodiments, but can be implemented in various configurations without departing from the spirit of the present invention.

In the above embodiment, the injection holes 31 are formed by laser irradiation from the outside of the body portion 30, but the injection holes 31 may be formed by various methods such as electric discharge machining, cutting work, 3D printing, and the like.

The invention claimed is:

1. A fuel injection device comprising:

a body portion which forms an injection hole through which a fuel is injected, wherein the body portion includes:

an inlet-channel-forming portion connected to an inflow port of the injection hole and forming an inlet channel of a fuel flow, and an outlet-channel-forming portion connected to the inlet channel and an outflow port of the fuel in the injection hole and forming an outlet channel of the fuel flow, and the outlet-channel-forming portion has a surface roughness which is larger than a surface roughness of the inlet-channel-forming portion, multiple grooves which extend from the inflow port to the outflow port are formed in the outlet-channel-forming portion in a circumferential direction, and each of the multiple grooves is arranged in such a manner that an interval between adjacent grooves becomes longer along a direction from the inflow port toward the outflow port.

2. The fuel injection device according to claim 1, wherein the outlet-channel-forming portion is provided with a plurality of convex portions or concave portions.

3. A fuel injection device comprising:

a body portion which forms an injection hole through which a fuel is injected, wherein the body portion includes:

an inlet-channel-forming portion connected to an inflow port of the injection hole and forming an inlet channel of a fuel flow, and an outlet-channel-forming portion connected to the inlet channel and an outflow port of the fuel in the injection hole and forming an outlet channel of the fuel flow, the outlet-channel-forming portion has a surface roughness which is larger than a surface roughness of the inlet-channel-forming portion, multiple grooves which extend from the inflow port to the outflow port are formed in the outlet-channel-forming portion in a circumferential direction, and each of the multiple grooves is arranged in such a manner that a depth of the grooves becomes deeper along a direction from the inflow port toward the outflow port.

4. A fuel injection device comprising:

a body portion which forms an injection hole through which a fuel is injected, wherein the body portion includes:

an inlet-channel-forming portion connected to an inflow port of the injection hole and forming an inlet channel of a fuel flow, and an outlet-channel-forming portion connected to the inlet channel and an outflow port of the fuel in the injection hole and forming an outlet channel of the fuel flow, the outlet-channel-forming portion has a surface roughness which is larger than a surface roughness of the inlet-channel-forming portion, wherein multiple grooves which extend from the inflow port to the outflow port are formed in the outlet-channel-forming portion in a circumferential direction, and each of the multiple grooves is arranged in such a manner that a width between the grooves becomes wider along a direction from the inflow port toward the outflow port.

5. The fuel injection device according to claim 1, wherein the outflow port has an area which is larger than an area of the inflow port.

6. The fuel injection device according to claim 1, wherein the outlet channel has a diameter which is expanded along a direction from the inflow port toward the outflow port.

7. A fuel injection device comprising:

a body portion which forms an injection hole through which a fuel is injected, wherein the body portion includes:

an inlet-channel-forming portion connected to an inflow port of the injection hole and forming an inlet channel of a fuel flow, and an outlet-channel-forming portion connected to the inlet channel and an outflow port of the fuel in the injection hole and forming an outlet channel of the fuel flow, the outlet-channel-forming portion has a surface roughness which is larger than a surface roughness of the inlet-channel-forming portion, the outlet channel has a diameter which is expanded along a direction from the inflow port toward the outflow port, and the inlet channel has a diameter which is expanded along a direction from the inflow port toward the outflow port, and the inlet channel has a diameter expansion ratio, which is a degree of expanding the diameter of the outlet channel and is larger than a diameter expansion ratio which is a degree of expanding the diameter of the inlet channel.

8. A fuel injection device comprising:

a body portion which forms an injection hole through which a fuel is injected, wherein the body portion includes:

an inlet-channel-forming portion connected to an inflow port of the injection hole and forming an inlet channel of a fuel flow, and an outlet-channel-forming portion connected to the inlet channel and an outflow port of the fuel in the injection hole and forming an outlet channel of the fuel flow, the outlet-channel-forming portion has a surface roughness which is larger than a surface roughness of the inlet-channel-forming portion, the diameter of each of the inlet channel and the outlet channel is expanded along a direction from the inflow port toward the outflow port, and a diameter expansion ratio which is a degree of expanding the diameter of the inlet channel and a diameter expansion ratio which is a degree of expanding the diameter of the outlet channel are the same as each other at a boundary between the inlet channel and the outlet channel.

9. A fuel injection device comprising:

a body portion which forms an injection hole through which a fuel is injected, wherein the body portion includes:

an inlet-channel-forming portion connected to an inflow port of the injection hole and forming an inlet channel of a fuel flow, and an outlet-channel-forming portion connected to the inlet channel and an outflow port of the fuel in the injection hole and forming an outlet channel of the fuel flow, the outlet-channel-forming portion has a surface roughness which is larger than a surface roughness of the inlet-channel-forming portion, and the outlet-channel-forming portion has a surface roughness in a circumferential direction, which is larger than a surface roughness along a direction from the inflow port to the outflow port.

10. The fuel injection device according to claim 1, wherein the body portion has a throttle portion which is formed on the inflow port of the outlet-channel-forming portion and an area of a central opening of the throttle portion is smaller than an area of the inflow port.

11. The fuel injection device according to claim 1, wherein the outlet-channel-forming portion has a surface roughness which is at least twice a surface roughness of the inlet-channel-forming portion.

12. A fuel injection device comprising:

a body portion which has an injection hole through which a fuel is injected, wherein the body portion includes:

an inlet-channel-forming portion connected to an inflow port of the fuel in the injection hole and forming an inlet channel of a fuel flow, and an outlet-channel-forming portion connected to the inlet channel and an outflow port of the fuel in the injection hole and forming an outlet channel of the fuel flow, diameters of the inlet channel and the outlet channel are expanded along a direction from the inflow port toward the outflow port, and a diameter expansion ratio which is a degree of expanding the diameter of the outlet channel is larger than a diameter expansion ratio which is a degree of expanding the diameter of the inlet channel.

13. The fuel injection device according to claim 12, wherein the diameter expansion ratio of the inlet channel is kept constant and the diameter expansion ratio of the outlet channel increases along a direction from the inflow port toward the outflow port.

14. The fuel injection device according to claim 12, wherein multiple grooves which extend from the inflow port to the outflow port are formed in at least one of the inlet-channel-forming portion and the outlet-channel-forming portion in a circumferential direction.

15. The fuel injection device according to claim 1, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an outlet virtual surface which extends in a cylindrical shape in a central axis direction of the injection hole along an inner wall of the end portion of the outlet-channel-forming portion on the outflow port in a state where the fuel injection device is disposed in the internal combustion engine.

16. The fuel injection device according to claim 1, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an inlet virtual surface which extends in a cylindrical shape in a central axis direction of the injection hole along an inner wall of the end portion of the inlet-channel-forming portion on the outlet-channel-forming portion in a state where the fuel injection device is disposed in the internal combustion engine.

17. A fuel injection device comprising:

a body portion which forms an injection hole through which a fuel is injected, wherein the body portion includes:

an inlet-channel-forming portion connected to an inflow port of the injection hole and forming an inlet channel of a fuel flow, and an outlet-channel-forming portion connected to the inlet channel and an outflow port of the fuel in the injection hole and forming an outlet channel of the fuel flow, and the outlet-channel-forming portion has a surface roughness which is larger than a surface roughness of the inlet-channel-forming portion, the fuel injection device is disposed in an internal combustion engine which includes an ignition device having an electric discharge portion exposed to an inside of a combustion chamber and capable of igniting the fuel injected from the injection hole due to discharge of the electric discharge portion, when a diameter of the combustion chamber is denoted by Ds and a distance between a center of the outflow port and the electric discharge portion in a state where the fuel injection device is disposed in the internal combustion engine is denoted by Dd, and the injection hole is defined to satisfy a relationship of $Dd \leq Ds/2$.

18. The fuel injection device according to claim 1, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein when a diameter of the combustion chamber is denoted by Ds, a distance between a center of the outflow port and the electric discharge portion in a state where the fuel injection device is disposed in the internal combustion engine is denoted by Dd, a length of the inlet-channel-forming portion in an axial direction is denoted by Ss, and a length of the outlet-channel-forming portion in the axial direction is denoted by Se, the injection hole is defined to satisfy a relationship of $Se/Ss \geq Ds/Dd$.

19. The fuel injection device according to claim 1, wherein the body portion has a valve seat which is formed in annular shape around the inflow port, the fuel injection device further comprises:

a cylindrical housing which is connected to the body portion;

a needle which is disposed inside of the housing in a state where one end of the needle is abuttable on the valve seat and the needle reciprocates in an axial direction, and opens and closes the injection hole when one end of the needle is spaced apart from the valve seat or abuts against the valve seat;

a movable core which is reciprocatably disposed in the housing together with the needle;

a fixed core which is disposed on a side of the movable core opposite to the valve seat inside of the housing;

a coil which attracts the movable core to the fixed core and move the needle to a side opposite to the valve seat upon energization;

a spring which urges the needle and the movable core toward the valve seat; and a control unit which controls an electric power to be supplied to the coil to cause the movement of the needle to a side opposite to the valve seat to be controllable, and the control unit is capable of executing a partial control for controlling the movement of the needle on the side opposite to the valve seat to enable a partial movement in a movable range of the needle.

20. The fuel injection device according to claim 3, wherein the outflow port has an area which is larger than an area of the inflow port.

21. The fuel injection device according to claim 4, wherein the outflow port has an area which is larger than an area of the inflow port.

22. The fuel injection device according to claim 3, wherein the outlet channel has a diameter which is expanded along a direction from the inflow port toward the outflow port.

23. The fuel injection device according to claim 4, wherein the outlet channel has a diameter which is expanded along a direction from the inflow port toward the outflow port.

24. The fuel injection device according to claim 3, wherein the body portion has a throttle portion which is formed on the inflow port of the outlet-channel-forming portion and an area of a central opening of the throttle portion is smaller than an area of the inflow port.

25. The fuel injection device according to claim 4, wherein the body portion has a throttle portion which is formed on the inflow port of the outlet-channel-forming portion and an area of a central opening of the throttle portion is smaller than an area of the inflow port.

26. The fuel injection device according to claim 7, wherein the body portion has a throttle portion which is formed on the inflow port of the outlet-channel-forming portion and an area of a central opening of the throttle portion is smaller than an area of the inflow port.

27. The fuel injection device according to claim 8, wherein the body portion has a throttle portion which is formed on the inflow port of the outlet-channel-forming portion and an area of a central opening of the throttle portion is smaller than an area of the inflow port.

28. The fuel injection device according to claim 9, wherein the body portion has a throttle portion which is formed on the inflow port of the outlet-channel-forming portion and an area of a central opening of the throttle portion is smaller than an area of the inflow port.

29. The fuel injection device according to claim 3, wherein the outlet-channel-forming portion has a surface roughness which is at least twice a surface roughness of the inlet-channel-forming portion.

30. The fuel injection device according to claim 4, wherein the outlet-channel-forming portion has a surface roughness which is at least twice a surface roughness of the inlet-channel-forming portion.

31. The fuel injection device according to claim 7, wherein the outlet-channel-forming portion has a surface roughness which is at least twice a surface roughness of the inlet-channel-forming portion.

32. The fuel injection device according to claim 8, wherein the outlet-channel-forming portion has a surface roughness which is at least twice a surface roughness of the inlet-channel-forming portion.

33. The fuel injection device according to claim 9, wherein the outlet-channel-forming portion has a surface roughness which is at least twice a surface roughness of the inlet-channel-forming portion.

34. The fuel injection device according to claim 3, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an outlet virtual surface which extends in a cylindrical shape in a central axis direction of the injection hole along an inner wall of the end portion of the outlet-channel-forming portion on the outflow port in a state where the fuel injection device is disposed in the internal combustion engine.

35. The fuel injection device according to claim 4, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an outlet virtual surface which extends in a cylindrical shape in a central axis direction of the injection hole along an inner wall of the end portion of the outlet-channel-forming portion on the outflow port in a state where the fuel injection device is disposed in the internal combustion engine.

36. The fuel injection device according to claim 7, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an outlet virtual surface which extends in a cylindrical shape in a central axis direction of the injection hole along an inner wall of the end portion of the outlet-channel-forming portion on the outflow port in a state where the fuel injection device is disposed in the internal combustion engine.

37. The fuel injection device according to claim 8, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an outlet virtual surface which extends in a cylindrical shape in a central axis direction of the injection hole along an inner wall of the end portion of the outlet-channel-forming portion on the outflow port in a state where the fuel injection device is disposed in the internal combustion engine.

38. The fuel injection device according to claim 9, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an outlet virtual surface which extends in a cylindrical shape in a central axis direction of the injection hole along an inner wall of the end portion of the outlet-channel-forming portion on the outflow port in a state where the fuel injection device is disposed in the internal combustion engine.

39. The fuel injection device according to claim 12, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an outlet virtual surface which extends in a cylindrical shape in a central axis direction of the injection hole along an inner wall of the end portion of the outlet-channel-forming portion on the outflow port in a state where the fuel injection device is disposed in the internal combustion engine.

40. The fuel injection device according to claim 3, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an inlet virtual surface which extends in a cylindrical shape in a central axis direction of the injection hole along an inner wall of the end portion of the inlet-channel-forming portion on the outlet-channel-forming portion in a state where the fuel injection device is disposed in the internal combustion engine.

41. The fuel injection device according to claim 4, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an inlet virtual surface which extends in a cylindrical shape in a central axis direction of the injection hole along an inner wall of the end portion of the inlet-channel-forming portion on the outlet-channel-forming portion in a state where the fuel injection device is disposed in the internal combustion engine.

42. The fuel injection device according to claim 7, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an inlet virtual surface which extends in a cylindrical shape in a central axis direction of the injection hole along an inner wall of the end portion of the inlet-channel-forming portion on the outlet-channel-forming portion in a state where the fuel injection device is disposed in the internal combustion engine.

43. The fuel injection device according to claim 8, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an inlet virtual surface which extends in a cylindrical shape in a central axis direction of the injection hole along an inner wall of the end portion of the inlet-channel-forming portion on the outlet-channel-forming portion in a state where the fuel injection device is disposed in the internal combustion engine.

44. The fuel injection device according to claim 9, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an inlet virtual surface which extends in a cylindrical shape in a central axis direction of the injection hole along an inner wall of the end portion of the inlet-channel-forming portion on the outlet-channel-forming portion in a state where the fuel injection device is disposed in the internal combustion engine.

45. The fuel injection device according to claim 12, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein the injection hole is formed to locate at least a part of the electric discharge portion inside of an inlet virtual surface which extends in a cylindrical shape in a central axis direction of the injection hole along an inner wall of the end portion of the inlet-channel-forming portion on the outlet-channel-forming portion in a state where the fuel injection device is disposed in the internal combustion engine.

46. The fuel injection device according to claim 3, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein when a diameter of the combustion chamber is denoted by Ds, a distance between a center of the outflow port and the electric discharge portion in a state where the fuel injection device is disposed in the internal combustion engine is denoted by Dd, a length of the inlet-channel-forming portion in an axial direction is denoted by Ss, and a length of the outlet-channel-forming portion in the axial direction is denoted by Se, the injection hole is defined to satisfy a relationship of $Se/Ss \geq Ds/Dd$.

47. The fuel injection device according to claim 4, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein when a diameter of the combustion chamber is denoted by Ds, a distance between a center of the outflow port and the electric discharge portion in a state where the fuel injection device is disposed in the internal combustion engine is denoted by Dd, a length of the inlet-channel-forming portion in an axial direction is denoted by Ss, and a length of the outlet-channel-forming portion in the axial direction is denoted by Se, the injection hole is defined to satisfy a relationship of $Se/Ss \geq Ds/Dd$.

48. The fuel injection device according to claim 7, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein when a diameter of the combustion chamber is denoted by Ds, a distance between a center of the outflow port and the electric discharge portion in a state where the fuel injection device is disposed in the internal combustion engine is denoted by Dd, a length of the inlet-channel-forming portion in an axial direction is denoted by Ss, and a length of the outlet-channel-forming portion in the axial direction is denoted by Se, the injection hole is defined to satisfy a relationship of $Se/Ss \geq Ds/Dd$.

49. The fuel injection device according to claim 8, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein when a diameter of the combustion chamber is denoted by Ds, a distance between a center of the outflow port and the electric discharge portion in a state where the fuel injection device is disposed in the internal combustion engine is denoted by Dd, a length of the inlet-channel-forming portion in an axial direction is denoted by Ss, and a length of the outlet-channel-forming portion in the axial direction is denoted by Se, the injection hole is defined to satisfy a relationship of $Se/Ss \geq Ds/Dd$.

50. The fuel injection device according to claim 9, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein when a diameter of the combustion chamber is denoted by Ds, a distance between a center of the outflow port and the electric discharge portion in a state where the fuel injection device is disposed in the internal combustion engine is denoted by Dd, a length of the inlet-channel-forming portion in an axial direction is denoted by Ss, and a length of the outlet-channel-forming portion in the axial direction is denoted by Se, the injection hole is defined to satisfy a relationship of $Se/Ss \geq Ds/Dd$.

51. The fuel injection device according to claim 12, the fuel injection device being disposed in an internal combustion engine which includes an ignition device having an electric discharge portion exposed to an inside of a combustion chamber and capable of igniting the fuel injected from the injection hole due to discharge of the electric discharge portion, wherein when a diameter of the combustion chamber is denoted by Ds, a distance between a center of the outflow port and the electric discharge portion in a state where the fuel injection device is disposed in the internal combustion engine is denoted by Dd, a length of the inlet-channel-forming portion in an axial direction is denoted by Ss, and a length of the outlet-channel-forming portion in the axial direction is denoted by Se, the injection hole is defined to satisfy a relationship of $Se/Ss \geq Ds/Dd$.

52. The fuel injection device according to claim 3, wherein the body portion has a valve seat which is formed in annular shape around the inflow port, the fuel injection device further comprises:

a cylindrical housing which is connected to the body portion;

a needle which is disposed inside of the housing in a state where one end of the needle is abuttable on the valve seat and the needle reciprocates in an axial direction, and opens and closes the injection hole when one end of the needle is spaced apart from the valve seat or abuts against the valve seat;

a movable core which is reciprocatably disposed in the housing together with the needle;

a fixed core which is disposed on a side of the movable core opposite to the valve seat inside of the housing;

a coil which attracts the movable core to the fixed core and move the needle to a side opposite to the valve seat upon energization;

a spring which urges the needle and the movable core toward the valve seat; and a control unit which controls an electric power to be supplied to the coil to cause the movement of the needle to a side opposite to the valve seat to be controllable, and the control unit is capable of executing a partial control for controlling the movement of the needle on the side opposite to the valve seat to enable a partial movement in a movable range of the needle.

53. The fuel injection device according to claim 4, wherein the body portion has a valve seat which is formed in annular shape around the inflow port, the fuel injection device further comprises:

a cylindrical housing which is connected to the body portion;

a needle which is disposed inside of the housing in a state where one end of the needle is abuttable on the valve seat and the needle reciprocates in an axial direction, and opens and closes the injection hole when one end of the needle is spaced apart from the valve seat or abuts against the valve seat;

a movable core which is reciprocatably disposed in the housing together with the needle;

a fixed core which is disposed on a side of the movable core opposite to the valve seat inside of the housing;

a coil which attracts the movable core to the fixed core and move the needle to a side opposite to the valve seat upon energization;

a spring which urges the needle and the movable core toward the valve seat; and a control unit which controls an electric power to be supplied to the coil to cause the movement of the needle to a side opposite to the valve seat to be controllable, and the control unit is capable of executing a partial control for controlling the movement of the needle on the side opposite to the valve seat to enable a partial movement in a movable range of the needle.

54. The fuel injection device according to claim 7, wherein the body portion has a valve seat which is formed in annular shape around the inflow port, the fuel injection device further comprises:

a cylindrical housing which is connected to the body portion;

a needle which is disposed inside of the housing in a state where one end of the needle is abuttable on the valve seat and the needle reciprocates in an axial direction, and opens and closes the injection hole when one end of the needle is spaced apart from the valve seat or abuts against the valve seat;

a movable core which is reciprocatably disposed in the housing together with the needle;

a fixed core which is disposed on a side of the movable core opposite to the valve seat inside of the housing;

a coil which attracts the movable core to the fixed core and move the needle to a side opposite to the valve seat upon energization;

a spring which urges the needle and the movable core toward the valve seat; and a control unit which controls an electric power to be supplied to the coil to cause the movement of the needle to a side opposite to the valve seat to be controllable, and the control unit is capable of executing a partial control for controlling the movement of the needle on the side opposite to the valve seat to enable a partial movement in a movable range of the needle.

55. The fuel injection device according to claim 8, wherein the body portion has a valve seat which is formed in annular shape around the inflow port, the fuel injection device further comprises:

a cylindrical housing which is connected to the body portion;

a needle which is disposed inside of the housing in a state where one end of the needle is abuttable on the valve seat and the needle reciprocates in an axial direction, and opens and closes the injection hole when one end of the needle is spaced apart from the valve seat or abuts against the valve seat;

a movable core which is reciprocatably disposed in the housing together with the needle;

a fixed core which is disposed on a side of the movable core opposite to the valve seat inside of the housing;

a coil which attracts the movable core to the fixed core and move the needle to a side opposite to the valve seat upon energization;

a spring which urges the needle and the movable core toward the valve seat; and a control unit which controls an electric power to be supplied to the coil to cause the movement of the needle to a side opposite to the valve seat to be controllable, and the control unit is capable of executing a partial control for controlling the movement of the needle on the side opposite to the valve seat to enable a partial movement in a movable range of the needle.

56. The fuel injection device according to claim 9, wherein the body portion has a valve seat which is formed in annular shape around the inflow port, the fuel injection device further comprises:

a cylindrical housing which is connected to the body portion;

a needle which is disposed inside of the housing in a state where one end of the needle is abuttable on the valve seat and the needle reciprocates in an axial direction, and opens and closes the injection hole when one end of the needle is spaced apart from the valve seat or abuts against the valve seat;

a movable core which is reciprocatably disposed in the housing together with the needle;

a fixed core which is disposed on a side of the movable core opposite to the valve seat inside of the housing;

a coil which attracts the movable core to the fixed core and move the needle to a side opposite to the valve seat upon energization;

a spring which urges the needle and the movable core toward the valve seat; and a control unit which controls an electric power to be supplied to the coil to cause the movement of the needle to a side opposite to the valve seat to be controllable, and the control unit is capable of executing a partial control for controlling the movement of the needle on the side opposite to the valve seat to enable a partial movement in a movable range of the needle.

57. The fuel injection device according to claim 12, wherein the body portion has a valve seat which is formed in annular shape around the inflow port, the fuel injection device further comprises:

a cylindrical housing which is connected to the body portion;

a needle which is disposed inside of the housing in a state where one end of the needle is abuttable on the valve seat and the needle reciprocates in an axial direction, and opens and closes the injection hole when one end of the needle is spaced apart from the valve seat or abuts against the valve seat;

a movable core which is reciprocatably disposed in the housing together with the needle;

a fixed core which is disposed on a side of the movable core opposite to the valve seat inside of the housing;

a coil which attracts the movable core to the fixed core and move the needle to a side opposite to the valve seat upon energization;

a spring which urges the needle and the movable core toward the valve seat; and a control unit which controls an electric power to be supplied to the coil to cause the movement of the needle to a side opposite to the valve seat to be controllable, and the control unit is capable of executing a partial control for controlling the movement of the needle on the side opposite to the valve seat to enable a partial movement in a movable range of the needle.

* * * * *